US009484139B2

(12) United States Patent
Yamada et al.

(10) Patent No.: US 9,484,139 B2
(45) Date of Patent: Nov. 1, 2016

(54) REACTOR, CONVERTER, AND POWER CONVERTER APPARATUS

(75) Inventors: Yukinori Yamada, Osaka (JP); Hajime Kawaguchi, Osaka (JP); Kouhei Yoshikawa, Osaka (JP)

(73) Assignee: Sumitomo Electric Industries, Ltd., Osaka-shi (JP)

( * ) Notice: Subject to any disclaimer, the term of this patent is extended or adjusted under 35 U.S.C. 154(b) by 0 days.

(21) Appl. No.: 14/116,729

(22) PCT Filed: Apr. 20, 2012

(86) PCT No.: PCT/JP2012/060670

§ 371 (c)(1),
(2), (4) Date: Nov. 8, 2013

(87) PCT Pub. No.: WO2012/153619

PCT Pub. Date: Nov. 15, 2012

(65) Prior Publication Data

US 2014/0085026 A1 Mar. 27, 2014

(30) Foreign Application Priority Data

May 10, 2011 (JP) ..... 2011-104924
Nov. 16, 2011 (JP) ..... 2011-250989
Mar. 5, 2012 (JP) ..... 2012-048569

(51) Int. Cl.
*H01F 27/02* (2006.01)
*H01F 27/06* (2006.01)
(Continued)

(52) U.S. Cl.
CPC ..... *H01F 27/02* (2013.01); *H01F 27/402* (2013.01); *H01F 37/00* (2013.01); *H01F 27/306* (2013.01)

(58) Field of Classification Search
CPC ..... H01F 37/00; H01F 27/02; H01F 27/306; H01F 27/266
USPC ..... 336/90, 65, 83, 96, 232, 212
See application file for complete search history.

(56) References Cited

U.S. PATENT DOCUMENTS 3,891,954 A * 6/1975 Konishi ..... 336/61
5,281,940 A 1/1994 Goto
(Continued)

FOREIGN PATENT DOCUMENTS

JP S56-155521 A 12/1981
JP 2005-108976 A 4/2005
(Continued)

OTHER PUBLICATIONS

International Search Report in PCT International Application No. PCT/JP2012/060670, dated Jul. 24, 2012.
(Continued)

*Primary Examiner* — Elvin G Enad
*Assistant Examiner* — Kazi Hossain
(74) *Attorney, Agent, or Firm* — Venable LLP; Michael A. Sartori; F. Brock Riggs

(57) ABSTRACT

The present invention provides a reactor with which a sensor for measuring the physical quantity (temperature or the like) of the reactor and an external apparatus can be connected to each other in a stable manner. The reactor 1A of the present invention includes a coil 2, a magnetic core 3 at which the coil 2 is disposed, and a case 4 storing a combined product 10 made up of the coil 2 and the magnetic core 3. The case 4 includes a bottom plate portion and a side wall portion 41 surrounding the combined product 10. The side wall portion 41 is made of an insulating resin. A connector hooking portion 44 on which a connector portion 72, which is coupled via a line 71 to a sensor such as a temperature sensor for measuring the physical quantity of the reactor 1A is hooked is integrally molded with the side wall portion 41 by the resin structuring the side wall portion 41. Allowing the connector portion 72 to be hooked on the connector hooking portion 44 and fixed thereto, the connector portion 72 is held by the case 4 in a stable manner, and with the reactor 1A, the connector portion 72 and the connector portion of an external apparatus can be connected to each other in a stable manner.

8 Claims, 11 Drawing Sheets

(51) Int. Cl.

| | |
|---|---|
| ***H01F 27/28*** | (2006.01) |
| ***H01F 27/24*** | (2006.01) |
| ***H01F 37/00*** | (2006.01) |
| ***H01F 27/40*** | (2006.01) |
| *H01F 27/30* | (2006.01) |

(56) References Cited

U.S. PATENT DOCUMENTS

| | | | | |
|---|---|---|---|---|
| 2009/0027151 | A1* | 1/2009 | Nakatsu et al. | 336/212 |
| 2009/0108971 | A1* | 4/2009 | Okamoto | 336/65 |
| 2010/0026434 | A1* | 2/2010 | Okamoto et al. | 336/65 |
| 2010/0226410 | A1* | 9/2010 | Maeno et al. | 374/208 |
| 2011/0156853 | A1 | 6/2011 | Kato et al. | |

FOREIGN PATENT DOCUMENTS

| | | | |
|---|---|---|---|
| JP | 2007-311403 | A | 11/2007 |
| JP | 2009-099596 | A | 5/2009 |
| JP | 2009-267360 | A | 11/2009 |
| JP | 2010-186766 | A | 8/2010 |
| JP | 2010-203998 | A | 9/2010 |
| JP | 2010-245458 | A | 10/2010 |
| JP | 2010-272771 | A | 12/2010 |
| JP | 2010272771 | * | 12/2010 |
| JP | 4952963 | B1 | 6/2012 |

OTHER PUBLICATIONS

International Search Report in PCT International Application No. PCT/JP2012/060668, dated Jul. 24, 2012.
U.S. Appl. No. 14/116,747, filed Nov. 8, 2013.
Notification of the First Office Action in Chinese Patent Application No. 201280022084.8, dated Jul. 30, 2015.
Notification of the First Office Action in Chinese Patent Application No. 201280021939.5, dated Jul. 30, 2015.
Office Action in U.S. Appl. No. 14/116,747 dated Mar. 13, 2015.

* cited by examiner (A)

(B)

REACTOR, CONVERTER, AND POWER CONVERTER APPARATUS

TECHNICAL FIELD

The present invention relates to a reactor used as a constituent component of a power converter apparatus, such as an in-vehicle DC-DC converter mounted on a vehicle such as a hybrid vehicle, a converter including the reactor, and a power converter apparatus including the converter. In particular, the present invention relates to a reactor with which a sensor for measuring the physical quantity (temperatures, current values and the like) of the reactor and an external apparatus can be connected to each other in a stable manner.

BACKGROUND ART

A reactor is one of the components of a circuit that performs a voltage step-up or step-down operation. Patent Literatures 1 and 2 disclose a reactor used for a converter mounted on a vehicle such as a hybrid vehicle. The reactor includes, for example: a coil having a pair of coil elements; an annular magnetic core at which the coil is disposed and which forms a closed magnetic path; a case storing a combined product made up of the coil and the magnetic core; and a sealing resin (secondary resin portion, potting resin) packed in the case.

When the coil generates heat upon energization, the loss of the reactor becomes great because of the heat. Accordingly, in general, the reactor is used as being fixed to an installation target such as a cooling base such that the coil can be cooled. Further, it is discussed to dispose a sensor for measuring the physical quantity such as temperatures or current at the place near the reactor when the reactor is used, to control current or the like supplied to the coil in accordance with the measured temperature or current, for example. Patent Literature 1 discloses disposition of a current sensor at the magnetic core. Patent Literature 2 discloses disposition of a temperature sensor between the coil elements.

CITATION LIST

Patent Literatures

Patent Literature 1: Japanese Unexamined Patent Publication No. 2009-267360

Patent Literature 2: Japanese Unexamined Patent Publication No. 2010-245458

SUMMARY OF INVENTION

Technical Problem

To the sensor, a line (see Patent Literature 1) for transmitting measured information to an external apparatus (measuring instrument) such as a control apparatus is attached. The line is provided with a connector portion (terminal: see Patent Literature 1) at its end. Allowing the connector portion to be connected to a connector portion of the external apparatus, the sensor and the external apparatus can be connected to each other with ease. However, conventionally, the disposition state of the connector portion coupled to the sensor is not fully discussed.

As described in Patent Literature 1, when the connector portion is simply disposed at the area near the opening portion of the case without being fixed, since the connector portion moves to some extent, it is difficult to establish a connection to the external apparatus in a stable manner. Further, since the connector portion moves to some extent, in the case where the connector portion is pulled during conveyance or installation of the reactor, not only the line coupled to the connector portion but also the sensor may be pulled, resulting in the sensor being pulled out, or being damaged by an excessive force being applied to the sensor. Since the connector portion is great in size as compared to the line, it may be snagged on any element. In order to properly measure the physical quantity, after the sensor is disposed at a prescribed position, it is desired to maintain the disposition position. Accordingly, when the sensor is pulled out, the sensor must be stored at the prescribed position again. Thus, a reduction in productivity may be invited due to an increase in the number of process steps. When the sensor is damaged, replacement is required because the damaged sensor cannot properly measure the physical quantity. Thus, a reduction in productivity is invited.

For example, it may be possible to fix the connector portion to the case by an adhesion tape or any appropriate jig such as a screw. However, with the conventional case, the connector portion cannot fully be supported. Even when the connector portion is fixed by an adhesion tape or the like, it may come off during the conveyance or connection work. Further, use of members such as a screw invites an increase in the number of components.

Under the circumstances described above, in order to maintain the state where the connector portion is disposed in a stable manner even during the connection work or conveyance, it is desired to develop a structure that can restrict the connector portion from shifting. In particular, it is desired to develop a structure that can fix the connector portion in a stable manner without inviting an increase in the number of components.

Accordingly, an object of the present invention is to provide a reactor with which a sensor for measuring the physical quantity of the reactor and an external apparatus can be connected to each other in a stable manner.

Solution to Problem

The present invention achieves the object stated above by employing a particular material for part of the case, and employing the structure in which a hooking portion on which the connector portion coupled to the sensor is hooked is integrally molded with the case by this particular material. Note that, in the present specification, "to integrally mold" means to mold one member together with other member. On the other hand, "to integrate" means to couple one member and other separate member to each other.

A reactor of the present invention includes; a coil; a magnetic core at which the coil is disposed; and a case that stores a combined product made up of the coil and the magnetic core. The case includes a bottom plate portion on which the combined product is placed and a side wall portion that surrounds the combined product. At least part of the side wall portion is made of resin. Then, a connector hooking portion on which a connector portion coupled to a sensor for measuring the physical quantity of the reactor is hooked is integrally molded with the side wall portion by the resin structuring the side wall portion.

With the reactor of the present invention, allowing the connector portion to be hooked on the connector hooking portion provided at the side wall portion, the connector portion can be fixed to the case, and the connector portion can be restricted from shifting. Accordingly, with the reactor of the present invention, the connector portion will not be displaced easily, and the connector portion and an external apparatus can be connected to each other with ease in a stable manner. Further, with the reactor of the present invention, since the connector portion is fixed to the case, it becomes possible to reduce or eliminate the possibility of occurrence of displacement, coming off, or damage of the sensor due to the connector portion being pulled during manufacture, installation or conveyance of the reactor, or when the connector portion and the external apparatus are connected to each other. Accordingly, the reactor of the present invention can maintain the state where the sensor is disposed at a prescribed position for a long period. Thus, information from the sensor disposed at a prescribed position can be acquired by an external apparatus connected via the connector portion, to properly measure a desired physical quantity.

Further, since the connector hooking portion is integrally molded with the side wall portion, an increase in the number of components will not be invited. Further, since the connector hooking portion is made of resin, even when it is in a complicated shape, it can be integrally molded with ease when at least part of the side wall portion is formed through injection molding or the like, and it can be formed with ease as compared to the case where the connector hooking portion is made of a metal material. Furthermore, since the connector hooking portion is provided at a proper position of the side wall portion, the connector portion and an external apparatus such as a control apparatus can be connected to each other with ease. Thanks to the features noted above, the reactor of the present invention also exhibits excellent productivity.

In addition, when the connector hooking portion is provided in the dead space at the side wall portion, an increase in the outer dimension of the reactor can be suppressed even when the connector portion is attached. Thus, a reactor being small in size can be obtained. Further, since the reactor of the present invention includes the case, the combined product can be protected from the external environment and can be mechanically protected.

The sensor may be, for example, a temperature sensor for measuring the temperature of the coil, or a current sensor for measuring the current that flows through the coil. The temperature sensor may include those having a heat sensitive element, such as thermistor, thermocouple, pyroelectric element and the like. The current sensor may include those having an element that can measure current by the physical quantity based on the magnetic field, such as a Hall element, a magnetoresistance element (an MR element), a magneto-impedance element (an MI element), a search coil and the like.

A line for transmitting information sensed by the sensor to an external apparatus is attached to the sensor. A connector portion is provided at the end of the line. The connector portion may be a so-called female-type connector or male-type connector. A commercially available connector portion accompanying any commercially available sensor can be used. When a commercially available connector portion is used, the connector hooking portion should be formed in accordance with the shape of the commercially available connector.

In one mode of the present invention, the side wall portion is entirely made of an insulating resin. The side wall portion is a member independent of the bottom plate portion. The side wall portion is integrated with the bottom plate portion through a fixation member. Further, in one mode of the present invention, the bottom plate portion is made of a metal material.

In this mode, since the entire side wall portion is made of an insulating resin, flexibility in selecting the disposition position of the connector hooking portion can be enhanced, and the connector portion can be attached to a desired place. Further, since this mode can insulate the coil and the side wall portion from each other, a reactor being small in size can be obtained by disposing the coil and the side wall portion in close proximity to each other. Further, since the bottom plate portion and the side wall portion are separate members, they can be separately manufactured. Therefore, in this mode, the manufacture manner is greatly flexible and the constituent materials can be selected from a wider range. Representatively, the bottom plate portion and the side wall portion can be made of different materials. In particular, when the bottom plate portion to which the combined product is brought into contact or arranged closely in the case is made of a metal material such as aluminum, the bottom plate portion can be used as a heat dissipation path. Thus, a reactor possessing an excellent heat dissipating characteristic can be obtained. Further, in this case, since the side wall portion is made of resin which is generally lighter than a metal material, a case being lighter than a conventional aluminum case can be obtained. Hence, a lightweight reactor can be obtained. Further, in this mode, since the side wall portion and the bottom plate portion can be integrated with each other after the combined product is disposed at the bottom plate portion, excellent assemblability is also exhibited with the reactor.

In one mode of the present invention, the magnetic core may include an inner core portion covered by the coil and an outer core portion exposed outside the coil. The side wall portion may include an overhanging portion. The connector hooking portion is provided at the overhanging portion. The overhanging portion covers at least part of the outer core portion, which part being disposed on the opening side of the case.

In this mode, the upper space on the opening portion side of the case can be effectively used, and hence a reactor being small in size can be obtained. Further, in this mode, the overhanging portion can provide protection from the external environment for the outer core portion, and prevent the components stored in the case from coming off.

In one mode of the present invention, a line hooking portion on which a line coupled to the sensor is hooked is further included, the line hooking portion being integrally molded with the side wall portion by the resin.

In this mode, without inviting an increase in the number of components, not only the connector portion but also the line of the sensor is hooked on the side wall portion, whereby the line can be restricted from shifting. Accordingly, in this mode, the possibility of occurrence of displacement, coming off, or damage of the sensor due to an excessive routing of the line during manufacture or installation of the reactor, or when the connector portion and the external apparatus are connected to each other can be reduced or eliminated. Accordingly, the state in which the sensor is disposed at a prescribed position can be maintained for a long period. Further, since the line hooking portion is also made of resin, even when the line hooking portion is in a complicated shape, it can be integrally molded with the side wall portion with ease through injection molding or the like. Further, when the reactor of the present invention includes a sealing resin, before sealing is performed, allowing the sensor to be disposed at a prescribed position and allowing the line to be hooked on the line hooking portion, the line will not become an obstacle when the sealing resin is packed. Thus, packing work can be performed with ease. After being sealed, the sensor and the coupled place of the line to the sensor can be fixed by the sealing resin. Accordingly, with this mode, the disposition position of the sensor can more surely be maintained.

In one mode of the present invention, the combined product may include an insulator interposed between the coil and the magnetic core. The insulator may be integrally structured by a pair of divided pieces being combined. A space formed as a result of the divided pieces being combined may be included as a storage portion for the sensor.

Thanks to provision of the insulator, in this mode, insulation between the coil and the magnetic core can be enhanced. Further, since the insulator is structured by the divided pieces, in particular by the divided pieces that can be divided in the axial direction of the coil, the insulator can be disposed at the magnetic core or the like with ease. Hence, this mode also provides excellent assemblability of the reactor. Further, in this mode, since the insulator includes the storage portion for the sensor, the sensor can be disposed more surely at a prescribed position, and an increase in the number of components because of provision of the storage portion will not be invited. Further, since the storage portion holds the sensor, in this mode, it is easier to prevent displacement of the sensor. In this mode, the divided pieces are structured such that the in-contact place and the out-of-contact place are formed at the places where the divided pieces oppose to each other when the divided pieces are combined. Then, this space formed by the out-of-contact place should be used as the storage portion.

The reactor of the present invention can be suitably used as a constituent component of a converter. The converter of the present invention may include a switching element, a driver circuit controlling an operation of the switching element, and a reactor smoothing a switching operation. By the operation of the switching element, an input voltage may be converted. The reactor may be the reactor of the present invention. The converter of the present invention can be suitably used as a constituent component of a power converter apparatus. The power converter apparatus of the present invention may include a converter converting an input voltage, and an inverter connected to the converter to perform interconversion between a direct current and an alternating current. A load may be driven by power obtained by the conversion of the inverter. The converter may be the converter of the present invention.

Since the converter of the present invention and the power converter apparatus of the present invention include the reactor of the present invention that makes it possible for a sensor to measure any physical quantity in a stable manner, control corresponding to the physical quantity and the like can be performed in an excellent manner.

Advantageous Effect of Invention

With the reactor of the present invention, a sensor that senses physical quantity such as temperatures and an external apparatus that measures physical quantity based on information from the sensor can be connected to each other in a stable manner.

BRIEF DESCRIPTION OF DRAWINGS

FIG. 3 (B) is a schematic perspective view of a connector portion hooked on the connector hooking portion; and FIG. 3 (C) is a cross-sectional view showing part of the cross section taken along C-C in FIG. 3 (B).

DESCRIPTION OF EMBODIMENTS

First Embodiment

Figure 1:
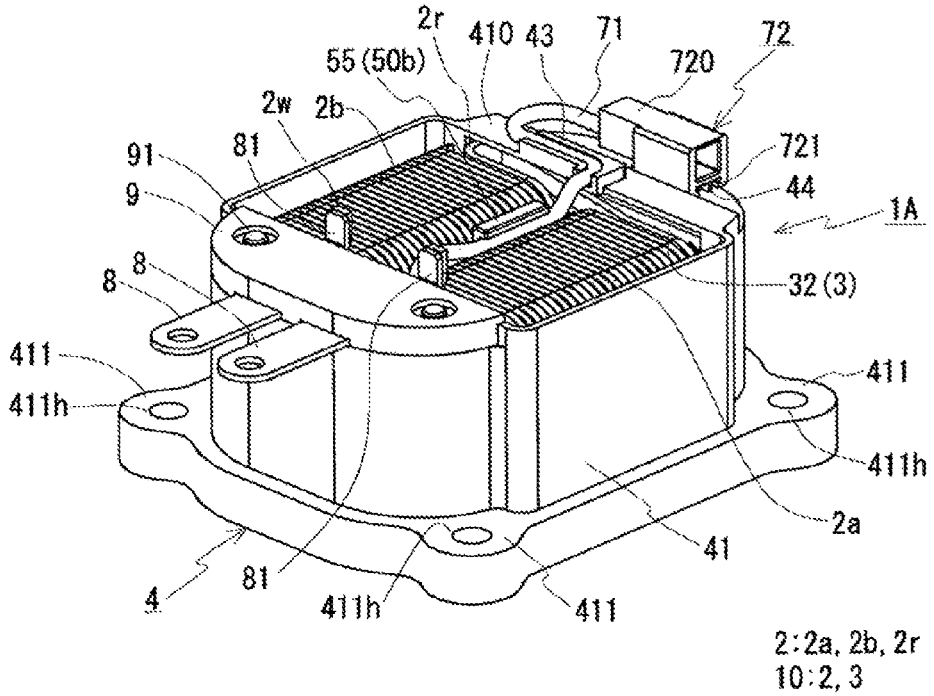
FIG. 1 is a schematic perspective view showing a reactor according to a first embodiment.

In the following, with reference to FIGS. 1 to 5, a description will be given of a reactor of a first embodiment. Identical reference symbols in the drawings denote identically named elements. Note that, the following description is given on the premise that the side becoming the installed side when the reactor is installed is the bottom side and the side being opposite thereto is the top side.

<<Overall Structure of Reactor>>

A reactor 1A includes a coil 2, a magnetic core 3 at which the coil 2 is disposed, and a case 4 storing a combined product 10 made up of the coil 2 and the magnetic core 3. The case 4 is a box-like element including a bottom plate portion 40 (FIG. 2) and a side wall portion 41 standing upright from the bottom plate portion 40, and the side opposing to the bottom plate portion 40 is open. The reactor 1A is best characterized by the following points: the side wall portion 41 of the case 4 is made of resin; and a connector hooking portion 44, on which a connector portion 72 coupled to a sensor 7 (FIG. 5) measuring the physical quantity of the reactor 1A is hooked, is integrally molded with the side wall portion 41 by the resin forming the side wall portion 41. In the following, each of the structures will be described in more detail.

[Sensor, Line, Connector Portion]

Figure 5:
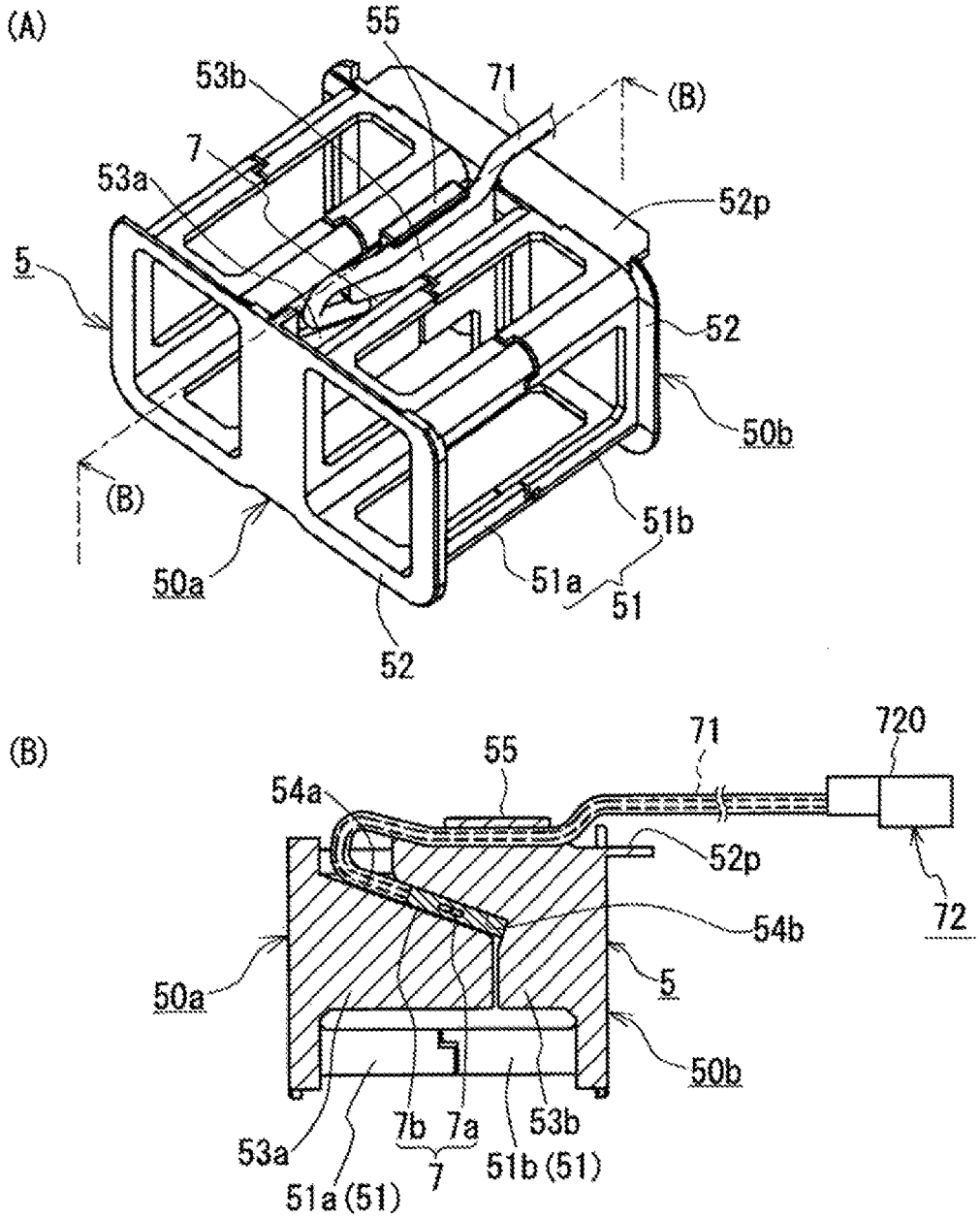
FIG. 5 shows an insulator included in the reactor according to the first embodiment, in which (A) is a perspective view and (B) is a cross-sectional view taken along B-B in (A).

Here, the sensor 7 is a temperature sensor. As shown in FIG. 5 (B), the sensor 7 may be a rod-like element including a heat sensitive element 7*a* such as a thermistor, and a protective portion 7*b* that protects the heat sensitive element 7*a*. The protective portion 7*b* may be a tube made of resin or the like.

To the sensor 7, a line 71 for transmitting sensed information to an external apparatus (not shown) such as a control apparatus is coupled. Further, the connector portion 72 is provided at the end of the line 71. Here, as shown in FIG. 5 (B), two lines 71 are stored together in a tube made of resin or the like. In this manner, the line 71 can be easily handled. Furthermore, the line 71 can be protected from the external environment or can be mechanically protected.

The connector portion 72 is a member that electrically connects the line 71 and the connector portion (not shown) of an external apparatus. The connector portion 72 includes an electrical connection portion (not shown) made of an electrically conductive material, a body 720 storing the electrical connection portion, and an engaging portion, whose description will be given later, provided at the body 720 and engaging with the connector hooking portion 44 provided at the side wall portion 41, whose description will be given later. The body 720 is molded into a shape corresponding to the connection mode (female type or male type). The preferable constituent material for the body 720 is an insulating material for enhancing insulation between the electrical connection portion and the peripheral components (such as the coil 2, the case 4 and the like). Specific insulating material may be an insulating resin such as polyphenylene sulfide (PPS) resin, polytetrafluoroethylene (PTFE) resin, polybutylene terephthalate (PBT) resin, or liquid crystal polymer (LCP). Here, the connector portion 72 is a quadrangular sleeve-like female-type connector made of PPS resin. The one end side of the connector portion 72 serves as the connection place to the line 71, and the other end side is opened to serve as the insertion place for the male-type connector of an external apparatus.

The engaging portion can be appropriately structured. Here, as shown in FIG. 3 (B), the engaging portion is structured by: paired L-shaped nail portions 721 formed to oppose to each other at one face of the quadrangular sleeve-like body 720; and a projection 722 projecting from the one face. The nail portions 721 clamp a Π-shaped slider stage 441 out of the connector hooking portion 44 included in the side wall portion 41, to slidably hold the body 720 relative to the connector hooking portion 44. The projection 722 is provided between the paired nail portions 721, and as shown in FIG. 3 (C), it has a trapezoidal-shaped cross section. This trapezoidal-shape is structured by an inclined plane, a vertical plane being perpendicular to one plane of the body 720, and a plane that connects between the inclined plane and the vertical plane, and that is parallel to the one face of the body 720. The connector hooking portion 44 has an L-shaped hook 442 on which the projection 722 is hooked. As shown in FIG. 3 (A), the hook 442 has an inclined plane along the inclined plane of the projection 722, and a contact plane that is brought into contact with the vertical plane of the projection 722. With this structure, when the connector portion 72 is slid in a particular direction relative to the slider stage 441 (in FIG. 3 (B), the direction in which the lower side of the connector portion 72 (the side coupled to the line 71 (FIG. 2)) is the leading direction), the inclined plane of the projection 722 slides along the inclined plane of the hook 422. When the inclined plane of the projection 722 climbs over the inclined plane of the hook 422, the vertical plane of the projection 722 and the contact plane of the hook 422 are brought into contact with each other. By this contact, the connector portion 72 is incapable of shifting even when it is forced to slide in the direction opposite to the particular direction, and is fixed to the connector hooking portion 44.

The engaging portion is only required to be capable of being fixed to the connector hooking portion 44, and it can be in any appropriate shape. The shape shown in FIG. 3 is of an exemplary nature. For example, the engaging portion may be a projection; the connector hooking portion 44 may be a recessed portion having an opening portion, which is in a shape similar to the projection while being slightly smaller than the projection; and the projection may be fixed to the recessed portion by the elastic deformation of the projection. When a commercially available product is employed as the connector portion 72, any product with an engaging portion of an appropriate shape can be used.

[Coil]

Figure 4:
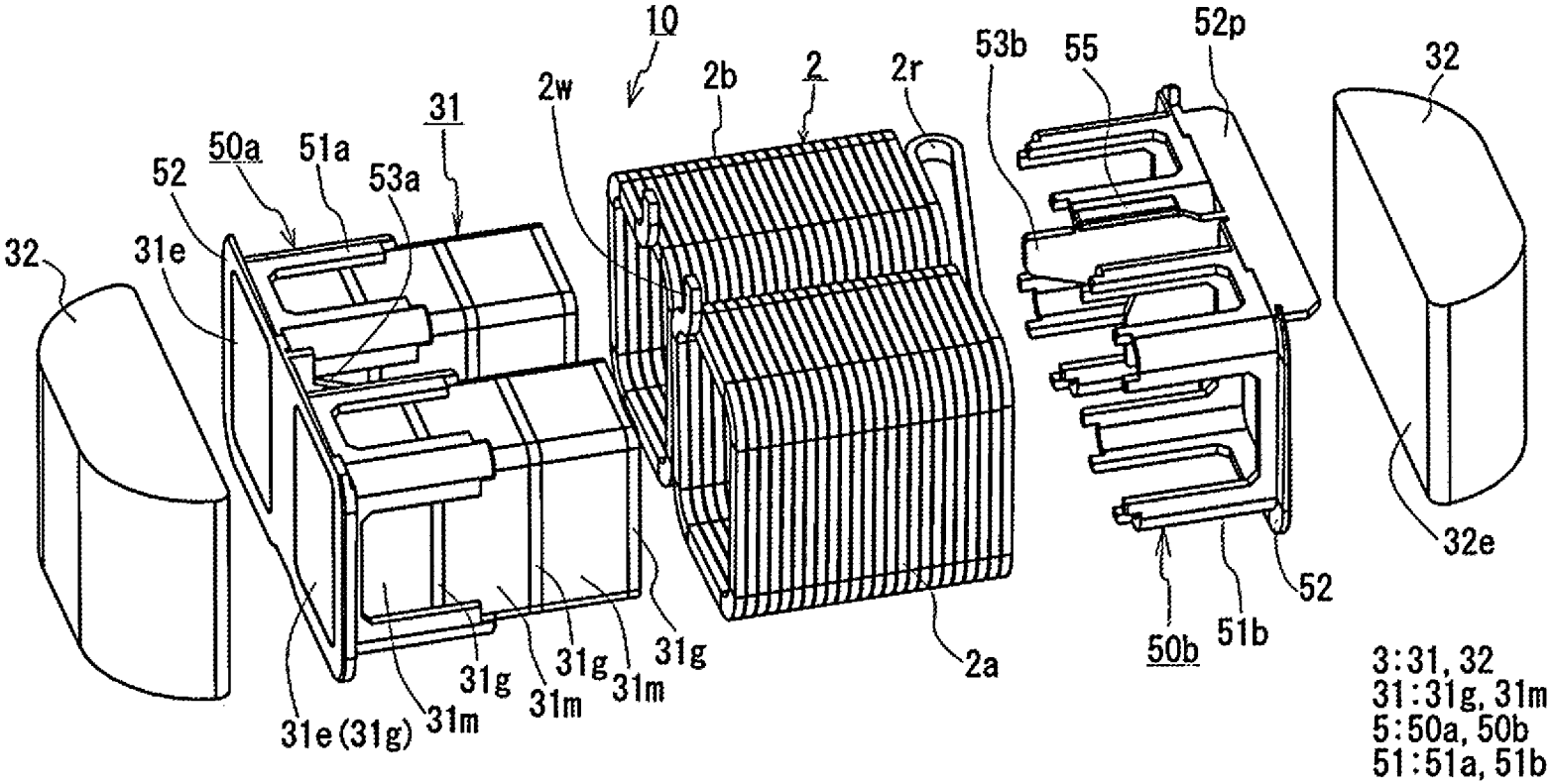
FIG. 4 is an exploded perspective view showing an overview of a combined product made up of a coil and a magnetic core included in the reactor according to the first embodiment.

A description will be given of the coil 2 with reference chiefly to FIGS. 2 and 4. The coil 2 includes a pair of coil elements 2*a* and 2*b* made of a single continuous wire 2*w* with no joining portion being spirally wound, and a coil couple portion 2*r* coupling the coil elements 2*a* and 2*b*. The coil elements 2*a* and 2*b* are hollow sleeve-like elements with identical number of turns. The coil elements 2*a* and 2*b* are juxtaposed (laterally juxtaposed) to each other such that their respective axial directions are in parallel to each other. On the other end side (on the right side in FIG. 4) of the coil 2, the wire 2*w* is partially bent in a U-shape, to form the coil couple portion 2*r*. With this structure, the winding direction of the coil elements 2*a* and 2*b* are identical to each other's.

Note that, the coil elements can be made of separate wires. The one ends of the wires of the coil elements may be joined through welding, soldering, fixation under pressure and the like to obtain a coil.

The wire 2*w* is suitably a coated wire, which includes a conductor made of an electrically conductive material such as copper or aluminum, or alloy thereof, the conductor being provided with an insulating coat made of an insulating material around its outer circumference. The thickness of the insulating coat is preferably 20 μm or more and 100 μm or less. As the thickness is greater, the pinholes become fewer, whereby the electrical insulating characteristic is enhanced. The conductor is representatively a rectangular wire. Alternatively, the conductor of various shapes can be used, such as those having a circular, elliptical, or polygonal cross section. The rectangular wire has the following advantages: (1) a coil being high in space factor can be formed with ease as compared to use of a round wire having a circular cross-section; (2) the wider contact area relative to a joining layer 42 included in the case 4, whose description will be given later, can be secured with ease; and (3) the wider contact area relative to terminal fittings 8, whose description will be given later, can be secured with ease. Here, a coated rectangular wire whose conductor is a copper-made rectangular wire and whose insulating coat is enamel (representatively, polyamide-imide) is used. The coil elements 2*a* and 2*b* are each an edgewise coil made of the coated rectangular wire being wound edgewise. Further, though the end face shape of the coil elements 2*a* and 2*b* herein is a rectangular shape with rounded corners, it can be circular or the like.

The opposite end portions of the wire 2*w* forming the coil 2 are extended as appropriate from the turn forming portion from one end side (the left side in FIG. 4) of the coil 2, and representatively drawn outside of the case 4 (FIG. 1). The opposite end portions of the wire have the conductor portion exposed by the insulating coat being peeled off. To the exposed conductor portions, the terminal fittings 8 (FIG. 1) made of an electrically conductive material are connected.

Via the terminal fittings 8, an external apparatus (not shown) such as a power supply supplying power to the coil 2 is connected.

[Magnetic Core]

A description will be given of the magnetic core 3 with reference to FIG. 4. The magnetic core 3 includes a pair of inner core portions 31 covered by the coil elements 2*a* and 2*b*, and a pair of outer core portions 32 around which no coil 2 is disposed and hence exposed outside the coil 2. The inner core portions 31 are each a columnar element (here, in a rectangular parallelepiped shape with rounded corners), with an outer shape conforming to the inner circumferential shape of corresponding one of the coil elements 2*a* and 2*b*. The outer core portions 32 are each a columnar element having a pair of trapezoidal-shaped faces. The magnetic core 3 is structured as follows: the outer core portions 32 are disposed to clamp the inner core portions 31, which are disposed to be away from each other; and the end faces 31*e* of the inner core portions 31 and the inner end faces 32*e* of the outer core portions 32 are brought into contact to each other, so as to form an annular shape. When the coil 2 is excited, the inner core portions 31 and the outer core portions 32 form a closed magnetic path.

The inner core portions 31 are each a lamination product in which core pieces 31*m* made of a magnetic material and gap members 31*g* representatively made of a non-magnetic material are alternately stacked. The outer core portions 32 are each a core piece made of a magnetic material.

The core pieces may each be a molded product in which magnetic powder is used, or a lamination product formed by a plurality of magnetic thin plates (e.g., electromagnetic steel sheets) provided with insulating coating being stacked. The exemplary molded product may be: a powder magnetic core using powder of iron group metal such as Fe, Co, Ni, Fe-base alloy such as Fe—Si, Fe—Ni, Fe—Al, Fe—Co, Fe—Cr, Fe—Si—Al and the like, rare-earth metal, or a soft magnetic material such as an amorphous magnetic element; a sintered product obtained by press molding the above-noted powder and thereafter sintering the same; and a hardened molded product obtained by subjecting a mixture of the above-noted powder and resin to injection molding, cast molding or the like. In addition, each core piece may be a ferrite core being a sintered product of a metal oxide. Employing the molded product, even a core piece or a magnetic core of a complicated three-dimensional shape can be formed with ease.

As the raw material of the powder magnetic core, what can be suitably used is coated powder made of coated particles in which particles made of the soft magnetic material are provided with an insulating coating on their surface. The powder magnetic core is representatively obtained by molding the coated powder and thereafter subjecting the coated powder to thermal treatment at a temperature equal to or lower than the heat resistant temperature of the insulating coating. Representative insulating coating may be those made of silicone resin, phosphate or the like.

The inner core portions 31 and the outer core portions 32 may be different from each other in material. For example, when the inner core portions 31 are the powder magnetic cores or the lamination products while the outer core portions 32 are the hardened molded products, the saturation magnetic flux density of the inner core portions 31 can be easily increased to be higher than the outer core portions 32. Alternatively, when the inner core portions 31 are the hardened molded products while the outer core portions 32 are the powder magnetic cores or the lamination products, the saturation magnetic flux density of the outer core portion 32 can be easily increased to be higher than that of the inner core portions 31, and leakage flux can be reduced with ease. Here, the core pieces are powder magnetic cores of soft magnetic powder containing iron, such as iron or steel.

The gap members 31*g* are each a plate-like member disposed at the clearance, which is provided between the core pieces for the purpose of adjusting inductance. The constituent material of the gap members 31*g* is those having permeability lower than that of the core pieces, such as alumina, glass epoxy resin, unsaturated polyester and the like. Representatively, the material of the gap members 31*g* is a non-magnetic material. Alternatively, for the gap members 31*g*, use of a mixed material in which magnetic powder (for example, ferrite, Fe, Fe—Si, Sendust and the like) is dispersed in a non-magnetic material such as ceramic or phenolic resin can reduce a leakage flux from each gap portion. It is also possible to employ an air gap.

The number of pieces of the core pieces or the gap member can be selected as appropriate such that the reactor 1A of the desired inductance is obtained. Further, the shape of the core pieces or the gap members can be appropriately selected. Here, though the mode in which each inner core portion 31 is structured by a plurality of core pieces 31*m* and a plurality of gap members 31*g* is shown, the gap member may be provided by one in number. Further, depending on the material of the core pieces, the gap members can be dispensed with. Still further, each outer core portion 32 may be made of a single core piece, or may be structured by a plurality of core pieces. In the case where the core pieces are structured by powder magnetic cores, when the inner core portions or the outer core portions are structured by a plurality of core pieces, excellent moldability is exhibited because each core piece can be reduced in size.

In order to integrate the core pieces with one another, or to integrate the core pieces 31*m* and the gap members 31*g* with each other, for example, an adhesive agent or an adhesion tape can be used. It is also possible to use an adhesive agent for forming the inner core portions 31, while using no adhesive agent in joining the inner core portions 31 and the outer core portions 32 to each other.

Alternatively, each inner core portion 31 may be integrated using a heat shrink tubing or a cold shrink tubing made of an insulating material. In this case, the insulating tube also functions as an insulating member between the coil element 2*a* or 2*b* and the inner core portions 31.

Alternatively, the magnetic core 3 can be annularly integrated through use of a band-like fastening member that can retain the magnetic core 3 annularly. Specifically, by allowing the band-like fastening member to surround the outer circumference of the annularly assembled magnetic core 3 or the outer circumference of the combined product 10, the magnetic core 3 can be retained in an annular manner. The band-like fastening member may be made of a material which is non-magnetic and exhibits excellent heat resistance. For example, commercially available tying members (Ty-Rap (registered trademark of Thomas & Betts International Inc.), PEEK Tie (ties available from Hellermanntyton Co., Ltd.), stainless steel bands (available from Panduit Corp.) and the like) can be used. Allowing a buffer member (for example, those made of resin such as ABS resin, PPS resin, PBT resin, epoxy resin or rubber such as silicone rubber) to be interposed between the magnetic core 3 or the coil 2 and the band-like fastening member, the magnetic core 3 or the coil 2 can be prevented from any damage which may otherwise result from the tightening force of the band-like fastening member.

Furthermore, in connection with the magnetic core 3 shown in this example, the installed-side faces of the inner core portions 31 and the installed-side faces of the outer core portions 32 are not flush with each other. The installed-side faces of the outer core portions 32 project further than the inner core portions 31, while being flush with the installed-side face of the coil 2. Accordingly, the installed-side face of the combined product 10 made up of the coil 2 and the magnetic core 3 is structured by the coil elements 2*a* and 2*b* and the outer core portions 32, and both the coil 2 and the magnetic core 3 can be brought into contact with the joining layer 42 (FIG. 2), whose description will be given later. Hence, the reactor 1A possesses an excellent heat dissipating characteristic. Further, since the installed-side face of the combined product 10 is made of both the coil 2 and the magnetic core 3, the contact area relative to the bottom plate portion 40 is adequately great. Thus, the reactor 1A is also excellent in stability when being installed. Further, since the core pieces are each made of a powder magnetic core, the portion of the outer core portions 32 projecting further than the inner core portions 31 can be used as the passage of the magnetic flux.

[Insulator]

The reactor 1A shown in this example further includes an insulator 5 interposed between the coil 2 and the magnetic core 3. The insulator 5 will be described with reference to FIGS. 4 and 5. The insulator 5 is integrally structured by a combination of a pair of divided pieces 50*a* and 50*b*, which can be divided in the axial direction of the coil 2. The insulator 5 includes sleeve-like portions 51 storing the inner core portions 31, and a pair of frame plate portions 52 interposed between the end faces of the coil elements 2*a* and 2*b* and the inner end faces 32*e* of the outer core portions 32. The sleeve-like portions 51 insulate the coil elements 2*a* and 2*b* and the inner core portions 31 from each other, and the frame plate portions 52 insulate the end faces of the coil elements 2*a* and 2*b* and the inner end faces 32*e* of the outer core portions 32 from each other. This insulator 5 includes a storage portion for the sensor 7.

The divided pieces 50*a* and 50*b* have a plurality of rod-like support portions 51*a* and 51*b* disposed at the corners of the inner core portions 31 along the axial direction of the inner core portions 31. The support portions 51*a* and 51*b* are provided to stand upright from the frame plate portions 52. When the divided pieces 50*a* and 50*b* are combined, the support portions 51*a* and 51*b* structure the sleeve-like portions 51.

The divided pieces 50*a* and 50*b* structuring the insulator 5 have engaging portions that engage with each other. Specifically, the opposite end portions of the support portions 51*a* and 51*b* are concave-convex shaped. These concave and convex portions function as the engaging portions that engage with each other as shown in FIG. 5(A), when the divided pieces 50*a* and 50*b* are combined. The engaging portions can be in any shape so long as they are capable of positioning the divided pieces 50*a* and 50*b* relative to each other. Here, though each engaging portion has an angulated stepped shape, it may have a curved shape such as a wavy shape, or a zigzag shape. Provision of the engaging portions facilitates positioning of the divided pieces 50*a* and 50*b*, and provides excellent assemblability. In this example, since the divided pieces 50*a* and 50*b* can be properly positioned, the storage portion for the sensor 7, whose description will be given later, can be formed properly. Thus, the sensor 7 can be disposed at a prescribed position.

Further, in this example, the support portions 51*a* and 51*b* are structured such that only part of the inner core portions 31 (mainly the corner portions) is covered by the sleeve-like portions 51 and the other part is exposed. Accordingly, for example, when a sealing resin is included, the contact area between the inner core portions 31 and the sealing resin can be increased. Furthermore, it facilitates bubbles to dissipate when the sealing resin is poured. Thus, excellent manufacturability of the reactor 1A can be exhibited.

Further, in this example, though the length of the support portions 51*a* and 51*b* (the length along the axial direction of the inner core portions 31) is adjusted such that the sleeve-like portions 51 are present over the entire length of the inner core portions 31, the length may be reduced. In this case, forming an insulating coat layer made of an insulating material at the outer circumference of the inner core portions 31, insulation between the coil elements 2*a* and 2*b* and the inner core portions 31 can be enhanced. The insulating coat layer can be formed by, for example, by an insulating tubing such as the heat shrink tubing, an insulating tape, insulating paper or the like.

Further, in this example, though the divided pieces 50*a* and 50*b* each include four support portions 51*a* and 51*b*, the number of the support portions 51*a* and 51*b* may be three or less for each of the divided pieces 50*a* and 50*b* so long as insulation between the inner core portions 31 and the coil elements 2*a* and 2*b* can be established (for example, only the two disposed on the polygonal line). Alternatively, the sleeve-like portion may be formed to be sleeve-like by the following manner, for example: integrating members having ]-shaped cross section and being divided in the direction perpendicular to the axial direction of the coil elements 2*a* and 2*b* with the frame plate portions, respectively; and thereafter combining the divided pieces.

The frame plate portions 52 are each a B-shaped flat plate portion having a pair of opening portions (through holes) into which the inner core portions 31 can be inserted.

The frame plate portions 52 respectively include partition portions 53*a* and 53*b*, in addition to the support portions 51*a* and 51*b*. The partition portions 53*a* and 53*b* are disposed so as to be interposed between the coil elements 2*a* and 2*b* when the divided pieces 50*a* and 50*b* are assembled to the coil 2. The partition portions 53*a* and 53*b* are provided so as to project from their respective frame plate portions 52 toward the coil. Thanks to the partition portions 53*a* and 53*b*, the coil elements 2*a* and 2*b* are out of contact from each other, and the coil elements 2*a* and 2*b* can be surely insulated from each other. Further, here, when the divided pieces 50*a* and 50*b* are combined, an in-contact place and an out-of-contact place are produced at the place where the partition portions 53*a* and 53*b* of the divided pieces 50*a* and 50*b* oppose to each other, and the space formed at the out-of-contact place is used as the storage portion for the sensor 7.

The partition portion 53*a* provided at one divided piece 50*a* is a trapezoidal plate as shown in FIG. 5(B) and includes: a storage forming portion 54*a*, which is an end face inclined upward from the center portion in the top-bottom direction (the direction being perpendicular to both the axial direction and the laterally juxtaposed direction of the coil element when the insulator 5 is assembled to the coil 2) in FIG. 5(B); and a straight end face being continuous to the inclined end face and being parallel to the top-bottom direction (hereinafter referred to as the straight end face).

The partition portion 53*b* provided at the other divided piece 50*b* is an L-shaped plate as shown in FIG. 5(B), and includes: a straight end face that opposes to the straight end face of the one divided piece 50*a* when the divided pieces 50*a* and 50*b* are combined; and a storage forming portion

54*b*, which is an end face being inclined along the storage forming portion 54*a*. The storage forming portions 54*a* and 54*b* are provided so as to be disposed between the inclined end faces with a prescribed interval between the storage forming portions 54*a* and 54*b*, when the divided pieces 50*a* and 50*b* are combined. By the storage forming portions 54*a* and 54*b*, a diagonal space (the space having an angle corresponding to the angle of the inclined end faces relative to the top-bottom direction=the out-of-contact place) is formed. The space formed by the storage forming portions 54*a* and 54*b* is used as the storage portion for the sensor 7 (FIG. 5(B)).

When the sensor 7 is stored in the storage portion, by the storage forming portion 54*b* of the other divided piece 50*b*, the sensor 7 is pressed toward the storage forming portion 54*a* of the one divided piece 50*a*. Here, the projecting length of L-shape of the storage forming portion 54*b* is adjusted such that the sensor 7 can be held at least by half of its length. Further, here, between the coil elements 2*a* and 2*b*, the storage forming portions 54*a* and 54*b* are structured such that the sensor 7 (the heat sensitive element 7*a*) is disposed at the central region including the center of the coil 2 in the axial direction (here, the region ranging from the center to the length 30% as great as the length of the coil 2 in the axial direction, that is, the region measuring 60% of the length of the coil 2 in the axial direction including the center).

Since the storage portion for the sensor 7 is structured by the partition portions 53*a* and 53*b* integrally molded with the insulator 5, an increase in the number of components because of provision of the storage portion will not be invited. Since the storage portion can hold the sensor 7, the sensor 7 is easily prevented from being displaced. Further, since the partition portions 53*a* and 53*b* are disposed between the coil elements 2*a* and 2*b*, the sensor 7 is also disposed between the coil elements 2*a* and 2*b*. Here, when the sensor 7 is a temperature sensor, the sensor can be disposed between the coil elements 2*a* and 2*b* where the temperature tends to rise. Therefore, the temperature of the coil 2 can be measured properly in this mode.

The size of the partition portions 53*a* and 53*b* can be selected as appropriate. In this example, the partition portions 53*a* and 53*b* are structured to be disposed to cover substantially the entire region of the coil elements 2*a* and 2*b* in the axial direction, and to be disposed at only part of the coil elements 2*a* and 2*b* in the top-bottom direction (in FIG. 5 (B), the structure in which no partition portions are present in the lower region). However, for example as shown in FIG. 6, the partition portions 53*a* and 53*b* can be formed such that the partition portions are present over substantially the entire region between the coil elements in the top-bottom direction.

Likewise, the shape of the partition portions 53*a* and 53*b* can be selected as appropriate. For example, as to the storage portion of the sensor 7, as shown in FIG. 6, it may be a storage portion with which the sensor 7 is disposed so as to be perpendicular to both the axial direction of the coil and the laterally juxtaposed direction of the coil elements (here, along the top-bottom direction).

Figure 6:
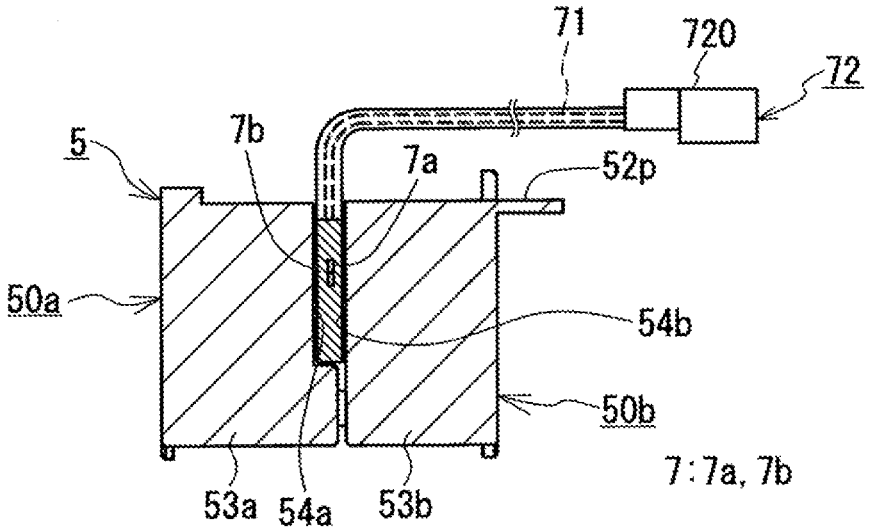
FIG. 6 is a cross-sectional view of an insulator in other mode.

More specifically, in connection with the insulator 5 shown in FIG. 6, the partition portion 53*a* of the one divided piece 50*a* is L-shaped; the two end faces arranged in an L-shape form the storage forming portion 54*a*; the partition portion 53*b* of the other divided piece 50*b* is quadrangular plate-shaped; and the end face of the other divided piece 50*b* serves as the storage forming portion 54*b*. When the divided pieces 50*a* and 50*b* are combined, a space having a quadrangular cross section extending in the top-bottom direction is provided by the storage forming portion 54*a* of the partition portion 53*a* and the storage forming portion 54*b* of the partition portion 53*b*. In this space, as shown in FIG. 6, the sensor 7 can be stored. With the insulator 5, one end face that forms the storage forming portion 54*a* of the one divided piece 50*a* (here, the face in parallel to the axial direction of the coil (the face-up end face in FIG. 6)) can be used as the stopper of the sensor 7. By adjusting the position of the one end face, the sensor 7 can be disposed at a prescribed position in the top-bottom direction of the coil elements 2*a* and 2*b* (FIG. 4 and others). With the insulator 5 shown in FIG. 6, the sensor 7 can be disposed at the storage portion more easily than with the insulator 5 shown in FIG. 5.

Further, in the example shown in FIG. 5, the other divided piece 50*b* is provided with a line hooking portion 55 on which the line 71 coupled to the sensor 7 is hooked. The shape of the line hooking portion 55 is not particularly limited. Here, it is a band-like piece projecting in the direction perpendicular to the partition portion 53*b*. The length of the band-like piece along the axial direction of the coil is not particularly limited. When the band-like piece is short, it will not become an obstacle while the sensor 7 is inserted into the storage portion, and hence insertion workability of the sensor 7 is achieved. When the band-like piece is long, the line 71 can more surely be held. Here, the line hooking portion 55 is provided such that: the sensor 7 is stored in the inclined storage portion; the line 71 is folded back in a hairpin manner from the base side of the sensor 7; and the folded back line 71 can be held by the line hooking portion 55. Since the line 71 is in such a folded-back state, the sensor 7 will not easily come off from the storage portion even when the line 71 is pulled.

Other exemplary line hooking portion may be as follows. A projection extending from the partition portion 53*b* upward in the top-bottom direction may be provided, and the projection may be used as the hooking portion for the line 71. In this case, the line 71 should be fixed by allowing the line 71 to wrap around the projection. Alternatively, a through hole (for example, a hole along the axial direction of the coil) may be provided at the partition portion 53*b*, and the through hole may be used as the hooking portion for the line 71. In this case, allowing the line 71 to penetrate through the through hole, the line 71 can be restricted from shifting to some degree. Alternatively, the partition portion 53*b* may be provided with a notch or a plurality of projections with which the line 71 can be clamped, such that the projections or the notch can be used as the hooking portion for the line 71. In this case, the line 71 should be fixed by allowing the line 71 to be clamped by the projections or the notch. Alternatively, the through hole, the projections, or the notch may be provided at part of the partition portion 53*a* or the frame plate portion 52, such that they can be used as the hooking portion of the line 71. The position of the line hooking portion 55 can be selected as appropriate. Further, the insulator may include a plurality of line hooking portions. In the present example, since the case 4 includes a line hooking portion 43 (whose description will be given later; FIGS. 1 and 2) also, an insulator with no line hooking portion 55 may be employed.

Furthermore, the other divided piece 50*b* also includes a pedestal 52*p* for placing the coil couple portion 2*r* and for insulating the coil couple portion 2*r* and the outer core portions 32 from each other. The pedestal 52*p* projects, in the frame plate portion 52 of the divided piece 50*b*, in the direction opposite to the partition portion 53*b* (the right side in FIG. 5(B)). That is, the frame plate portion 52 of the divided piece 50*b* has the partition portion 53*b* projecting toward one side (the left side in FIG. 5(B)), and has the pedestal 52*p* projecting toward the other side.

Alternatively, when a positioning projection (not shown) that positions the corresponding outer core portion 32 is provided at the face being brought into contact with the outer core portion 32 in the frame plate portion 52 of each of the divided pieces 50*a* and 50*b*, excellent assemblability is exhibited. The positioning projection may be dispensed with.

As the constituent material of the insulator 5, an insulating material such as polyphenylene sulfide (PPS) resin, polytetrafluoroethylene (PTFE) resin, polybutylene terephthalate (PBT) resin, liquid crystal polymer (LCP) and the like can be used. The insulator 5 can be molded with ease through injection molding or the like, even when it is in a complicated shape.

[Case]

A description will be given of the case 4 with reference to FIG. 2. The case 4 includes the flat plate-like bottom plate portion 40 on which the combined product 10 made up of the coil 2 and the magnetic core 3 is placed, and a frame-like side wall portion 41 provided to stand upright from the bottom plate portion 40. With this case 4, the bottom plate portion 40 and the side wall portion 41 are not integrally molded, i.e., being independent members, and are integrated by fixation members. Further, the bottom plate portion 40 is provided with a joining layer 42 at its one face (inner face). The joining layer 42 fixes the coil 2 to the bottom plate portion 40. Then, the reactor 1A is best characterized by the following features: the side wall portion 41 is molded by an insulating resin; and the connector hooking portion 44 on which the connector portion 72, which is provided at the end of the line 71 connected to the sensor 7 (FIG. 5 and others), is hooked is integrally molded with the side wall portion 41. Further, in this example, the line hooking portion 43 on which the line 71 is hooked is also integrally molded with the side wall portion 41.

(Bottom Plate Portion)

The bottom plate portion 40 is a quadrangular plate, and is fixed to an installation target so as to be brought into contact therewith when the reactor 1A is installed in the installation target. Though the installation state where the bottom plate portion 40 is on the bottom side is shown in this description, in another possible installation state, the bottom plate portion 40 may be oriented upward or sideways. The outer shape of the bottom plate portion 40 can be selected as appropriate. Here, the bottom plate portion 40 has attaching portions 400 respectively projecting from the four corners. The side wall portion 41, whose description will be given later, also has attaching portions 411. When the bottom plate portion 40 and the side wall portion 41 are combined to form the case 4, the attaching portions 400 overlap with the attaching portions 411 of the side wall portion 41. The attaching portions 400 and 411 are respectively provided with bolt holes 400*h* and 411*h* into which bolts (not shown) for fixing the case 4 to the installation target are inserted. The bolt holes 400*h* of the bottom plate portion 40 and the bolt holes 411*h* of the side wall portion 41 are formed to be continuous to each other. The bolt holes 400*h* and 411*h* may each be a through hole not being threaded or may be a screw hole being threaded. The number of pieces or the like of the bolt holes 400*h* and 411*h* can be arbitrarily selected.

Alternatively, the side wall portion 41 may not be provided with the attaching portions, and solely the bottom plate portion 40 may be provided with the attaching portions 400. In this case, the outer shape of the bottom plate portion 40 is formed such that the attaching portions 400 of the bottom plate portion 40 project from the outer shape of the side wall portion. Alternatively, solely the side wall portion 41 may have the attaching portions 411, and the bottom plate portion 40 may have no attaching portions. In this case, the outer shape of the side wall portion 41 is formed such that the attaching portions 411 of the side wall portion 41 project from the outer shape of the bottom plate portion 40.

It is preferable that the bottom plate portion 40 is made of an electrically conductive material such as a metal material. Since metal materials are generally high in thermal conductivity, the bottom plate portion 40 possessing an excellent heat dissipating characteristic can be obtained. Further, since the bottom plate portion 40 to which the coil 2 is joined via the joining layer 42 possesses an excellent heat dissipating characteristic, heat of the coil 2 can be efficiently transferred to the installation target via the bottom plate portion 40. Accordingly, a reactor possessing an excellent heat dissipating characteristic can be obtained. In particular, since the bottom plate portion 40 is disposed near the coil 2, it is preferable that the metal material is a non-magnetic metal.

Specific metal may include, for example, aluminum (thermal conductivity: 237 W/m·K) and aluminum alloy, magnesium (156 W/m·K) and magnesium alloy, copper (398 W/m·K) and copper alloy, silver (427 W/m·K) and silver alloy, iron (80 W/m·K), austenitic stainless steel (for example, SUS304: 16.7 W/m·K) and the like. Using such aluminum, magnesium, and alloy thereof, a lightweight case can be obtained. Thus, it becomes possible to contribute toward reducing the weight of the reactor. In particular, since aluminum and aluminum alloy exhibit excellent corrosion resistance, and magnesium and magnesium alloy excellently withstand vibrations, such materials can be suitably used for in-vehicle components. When the bottom plate portion 40 is to be formed by any metal material, it can be achieved by casting such as die casting, press working (representatively, punching) or the like.

When the bottom plate portion 40 is to be formed by an electrically conductive material, by performing anodizing such as alumite treatment such that very thin insulating coating (having a thickness of approximately 1 μm to 10 μm) on the surface of the bottom plate portion 40, insulation between the bottom plate portion 40 and the coil 2 can be enhanced.

(Side Wall Portion)

The side wall portion 41 is a quadrangular frame-like element. The side wall portion 41 is disposed to surround the combined product 10 when the case 4 is assembled while having its one opening portion closed by the bottom plate portion 40 and its other opening portion being opened. Here, in connection with the side wall portion 41, the region becoming the installation side when the reactor 1A is installed at the installation target is quadrangular conforming to the outer shape of the bottom plate portion 40, and the region on the open side is in a curved plane shape conforming to the outer circumference face of the combined product 10 made up of the coil 2 and the magnetic core 3.

Further, here, at the region on the opening side of the side wall portion 41, overhanging portions 410 are provided so as to cover the trapezoidal-shaped faces of the outer core portions 32 of the combined product 10. To one overhanging portion (the one on the left side in FIG. 2), the terminal fittings 8 are fixed by the terminal fixing members 9, and used as the terminal block. At the other overhanging portion 410, the line hooking portion 43 and the connector hooking portion 44 are provided. Accordingly, as shown in FIG. 1, in connection with the combined product 10 stored in the case 4, the coil 2 is exposed while the magnetic core 3 is substantially covered by the constituent material structuring the case 4. Provision of the overhanging portions 410 provides various effects such as: (1) an improvement in vibration resistance; (2) an improvement in rigidity of the case 4 (the side wall portion 41); (3) protection from the external environment and mechanical protection for the magnetic core 3 (the outer core portions 32); and (4) prevention of the combined product 10 from coming off. Further, here, the overhanging portion 410 can be used as the formation place for the hooking portions 43 and 44. The overhanging portions 410 can be dispensed with, to expose the coil 2 and at least part of the trapezoidal-shaped face of one of or both of the outer core portions 32 (in the following fifth embodiment (FIG. 9), the trapezoidal-shaped face of the one outer core portion 32 is partially exposed).

The side wall portion 41 is made of resin, in particular, an insulating resin. Specific resin may be PBT resin, urethane resin, PPS resin, acrylonitrile butadiene styrene (ABS) resin and the like. Since the side wall portion 41 is made of an insulating resin, insulation between the coil 2 and the case 4 can be enhanced. Therefore, in the state where the case 4 is assembled, the outer circumference face of the coil 2 and the inner circumference face of the side wall portion 41 can be disposed in close proximity to each other. Here, the interval between the outer circumference face of the coil 2 and the inner circumference face of the side wall portion 41 is approximately 0 mm to 1.0 mm, i.e., very narrow. Further, since the side wall portion 41 is made of resin, even a complicated three-dimensional shape, such as those with the overhanging portions 410 and the hooking portions 43 and 44, can be molded with ease through injection molding or the like. In particular, in this example, since the entire side wall portion 41 is made of resin, formation is easier as compared to the case where the side wall portion 41 is partially made of different materials, and furthermore, the reactor 1A can be lightweight. When a filler made of ceramic, whose description will be given later, is mixed into the resin, the heat dissipating characteristic of the side wall portion 41 can be enhanced, and a case with an excellent heat dissipating characteristic can be obtained.

Here, the bottom plate portion 40 is made of aluminum alloy, and the side wall portion 41 is made of PBT resin. Thus, the thermal conductivity of the bottom plate portion 40 is fully higher than that of the side wall portion 41.

[Connector Hooking Portion]

Figure 2:
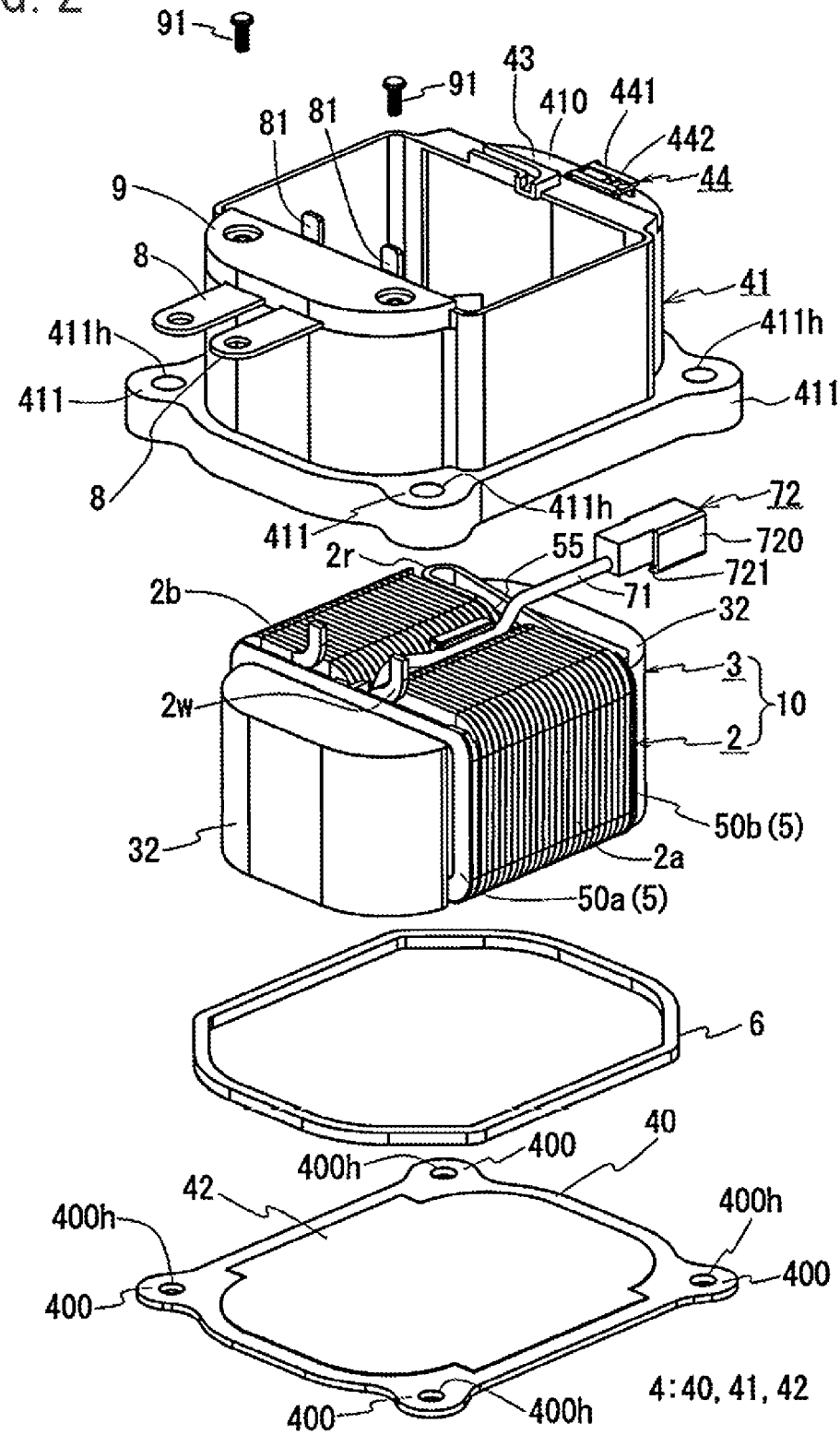
FIG. 2 is an exploded perspective view showing an overview of the reactor according to the first embodiment.
Figure 3:
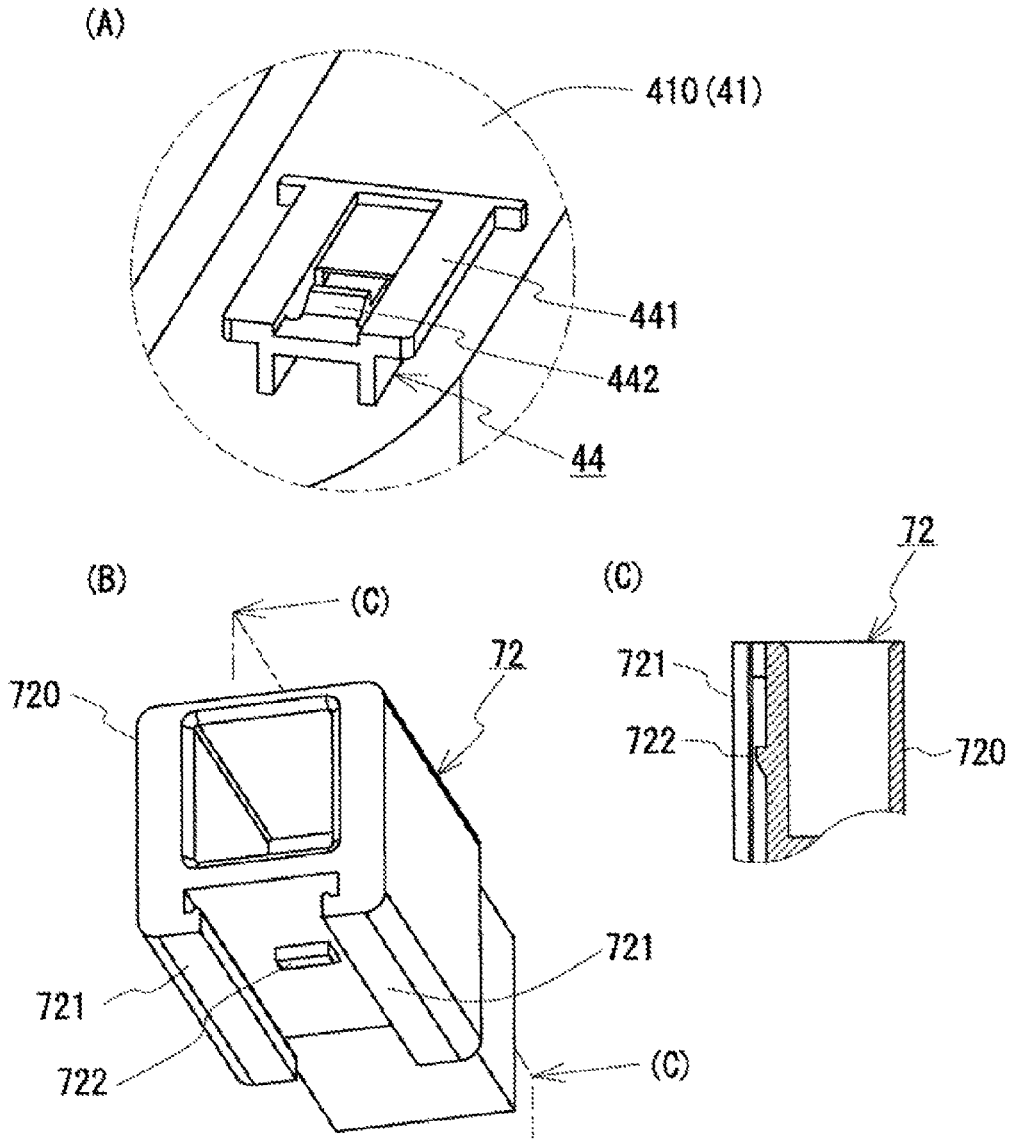
FIG. 3 (A) is a schematic perspective view of a connector hooking portion provided at a case included in the reactor according to the first embodiment.

The side wall portion 41 includes the connector hooking portion 44 on which the connector portion 72 coupled to the sensor 7 (FIG. 5) is hooked, at the overhanging portion 410 of the one (the one on the right side in FIG. 2). Here, as shown in FIG. 3 (A), the connector hooking portion 44 includes a Π-shaped slider stage 441 on which the nail portions 721 of the connector portion 72 are hooked, and the hook 442 on which the projection 722 is hooked. Further, here, the connector hooking portion 44 is disposed in parallel to the laterally juxtaposed direction of the coil, such that the connector portion 72 can be slid from the near side to the depth side in FIG. 3 (A). As described above, the shape of the connector hooking portion 44 can be selected as appropriate in accordance with the shape of the connector portion 72. Further, the disposition position and the disposition direction can also be selected as appropriate, and FIG. 2 is of an exemplary nature. Here, the one overhanging portion 410 includes a portion that covers the one outer core portion 32 and a portion that covers the coil couple portion 2*r*. The one overhanging portion 410 is in a stepped shape in which the portion covering the coil couple portion 2*r* is higher than the portion covering the outer core portion 32. The connector hooking portion 44 is provided at the lower level in the overhanging portion 410, that is, at the portion covering the outer core portion 32. With this structure, the volume can be suppressed even when the connector portion 72 is hooked on the connector hooking portion 44 (FIG. 1). Alternatively, for example, the connector hooking portion can be formed on the terminal block side where the terminal fittings 8 are disposed, in place of the overhanging portion 410 on the coil couple portion 2*r* side in FIG. 1.

[Line Hooking Portion]

The side wall portion 41 includes the line hooking portion 43 on which the line 71 coupled to the sensor 7 (FIG. 5) is hooked, at the overhanging portion 410 covering the one (the one on the right side in FIG. 2) outer core portion 32.

Figure 8:
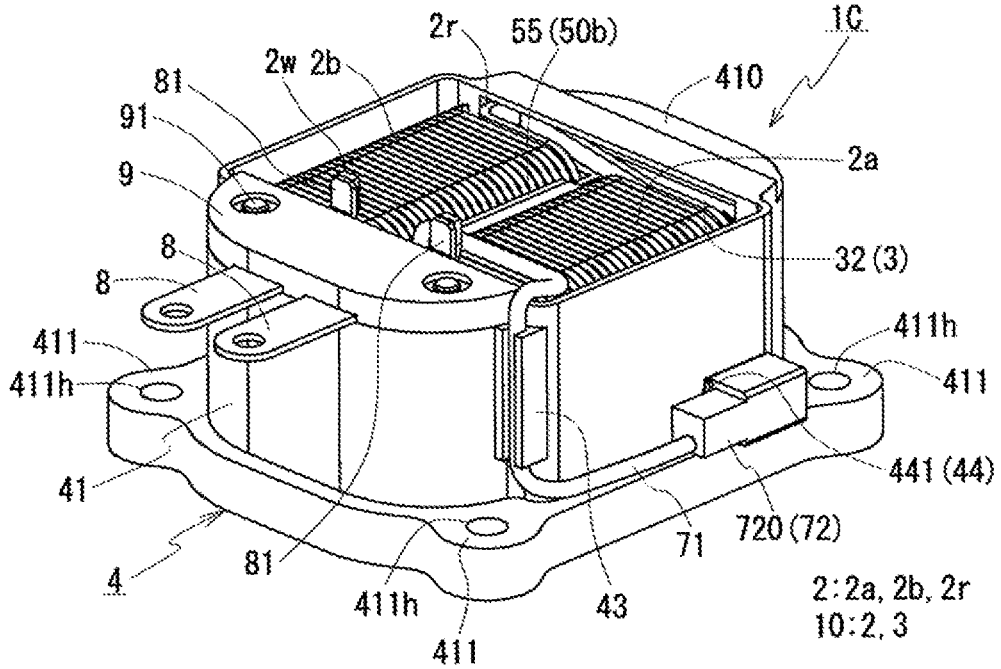
FIG. 8 (A) is a schematic perspective view of a reactor according to a third embodiment, and FIG. 8 (B) is a schematic perspective view of a reactor according to a fourth embodiment.
Figure 8:
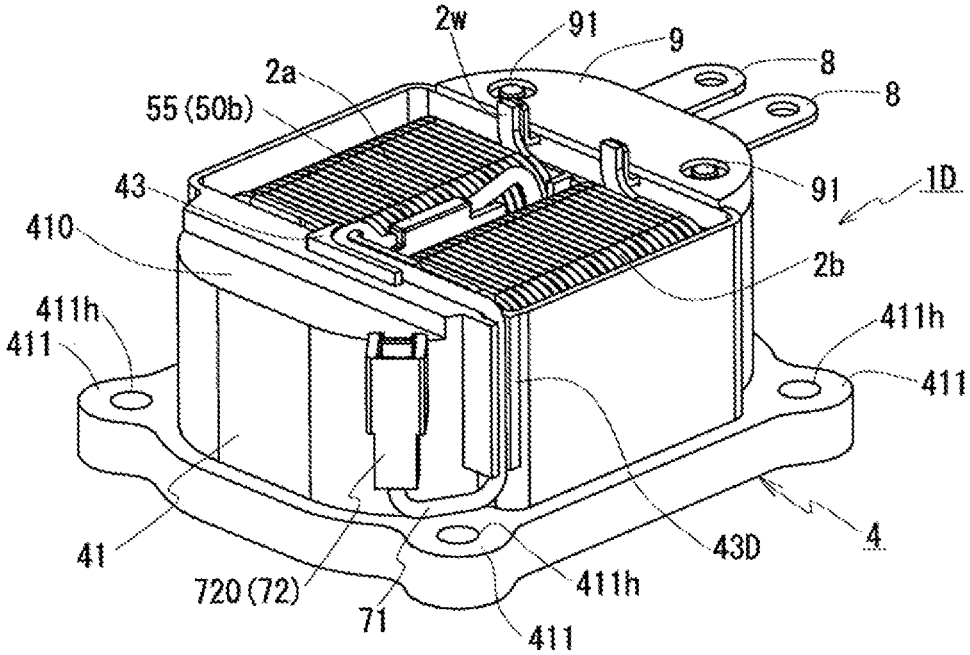

The shape, number of pieces, and disposition position of the line hooking portion 43 can be selected as appropriate. Here, an L-shaped groove provided at the portion covering the coil couple portion 2*r* in the one overhanging portion 410 serves as the line hooking portion 43. The groove has a width or depth in accordance with the diameter of the line 71. Allowing the line 71 to be fitted into the groove, part of the line 71 (the region corresponding to the length of the groove and the depth of the groove) can be held, and the line 71 can be disposed in the direction corresponding to the orientation of the groove. That is, the line 71 can be positioned by the groove to some degree. The shape, length and depth of the groove can be selected as appropriate. For example, it can be straight as shown in FIG. 8, which will be referred to later, or in a curved shape such as a wavy or bowed shape. Further, the number of pieces of the line hooking portion having such a groove can also be selected as appropriate. A plurality of such line hooking portions as shown in FIG. 8 (B), which will be referred to later, can be employed.

Here, the groove structuring the line hooking portion 43 is provided such that the line 71 will not become an obstacle when the connector portion 72 and the connector portion of the external apparatus are connected to each other. Specifically, the side of the line 71 coupled to the connector portion 72 is bent in a U-shape. The groove is provided in an L-shape, such that the coupled side of the sensor 7 (FIG. 5) becomes away from the opening portion of the connector portion 72 and the line 71 is disposed therein. Since the groove is provided in such a manner, while the line 71 drawn from between the coil elements 2*a* and 2*b* is disposed in the upper space of the overhanging portion 410, the line 71 will not cross the opening portion of the connector portion 72. Thus, the connector portion 72 and the connector portion of an external apparatus can be connected to each other with ease.

In addition, for example, the line hooking portion may be formed as a C-shaped piece, an L-shaped piece, or a through hole or at least one projection similarly to the line hooking portion provided at the insulator 5 described above, or may be a combination of them. The C-shaped piece or the L-shaped piece can catch the line by the line being hooked thereon. The through hole can catch the line by the line being inserted, and the line will not easily come off. The one projection can catch the line by the line being wounded as described above. With a plurality of projections, having the projections aligned linearly or staggered with desired intervals and adjusting the interval of the projections, the line can be clamped as described above. Further, a projection may be further provided to the C-shaped piece or the L-shaped piece (see the fifth embodiment (FIG. 9), whose description will be given later). The formation position of the line hooking portion may be at any position at the periphery forming the opening portion of the case 4 (here, the periphery of the overhanging portion 410 or the periphery being parallel to the axis of the coil 2). The line hooking portion can be provided so as to project into the upper space of the coil 2 from the periphery, or to project outward of the case 4 or into the upper space of the case 4. In the former case, the line does not project from the case, and a small-sized reactor can be obtained. In the latter case, the line hooking work is facilitated. The line hooking portion of a desired shape can be provided by one in number or in a plurality of numbers. When a plurality of line hooking portions are provided at the side wall portion, lines of a plurality of different sensors can be hooked. The number of pieces of the line hooking portions should be changed in accordance with the number of the sensors. Alternatively, a mode in which a line of one sensor can be hooked on a plurality of line hooking portions can be employed. In this mode, the line can be held more surely. When a plurality of L-shaped pieces, C-shaped pieces, or through holes are provided, allowing their respective opening portions to be differently oriented, the line can be meandered and hooked. Thus, the line can be strongly fixed with ease.

[Attaching Portion]

The region on the installation side of the side wall portion 41 is provided with the attaching portions 411 respectively projecting from the four corners, similarly to the bottom plate portion 40. The attaching portions 411 are each provided with the bolt hole 411*h*, to structure attaching places. The bolt hole 411*h* may be formed solely by the constituent material of the side wall portion 41, or may be formed by disposing a tubular element made of a different material. For example, employing a metal pipe made of metal such as brass, steel, or stainless steel as the tubular element, excellent strength is exhibited, and hence creep deformation can be suppressed as compared to the case where the bottom plate portion 40 is solely made of resin. Here, a metal pipe is disposed to form each bolt hole 411*h*.

[Terminal Block, Terminal Fittings]

To the side wall portion 41, a pair of terminal fittings 8 to which the ends of the wire 2*w* are respectively connected is fixed to the other (the left one in FIG. 2) overhanging portion 410.

The terminal fittings 8 are each an L-shaped electrically conductive member, made of a plate member made of an electrically conductive material such as copper, copper alloy, aluminum, aluminum alloy being bent as appropriate. At the one end sides of the terminal fittings 8, joining portions 81 to which the ends of the wire 2*w* are joined through soldering or welding is provided. At the other end side of each terminal fitting 8, a through hole into which a coupling member such as a bolt for connecting an external apparatus such as a power supply is fitted is provided. The center portion (not shown) is fixed to the side wall portion 41.

The shape of the terminal fittings 8 shown in FIG. 2 is of an exemplary nature, and can be changed as appropriate so long as at least the joining portion, the connection place relative to the external apparatus, and the fixing place relative to the side wall portion 41 are included. Though each of the joining portions 81 is flat plate-like, it can be U-shaped or the like. In the latter case, after having the end of the wire interposed in the U-shaped space and pouring solder into the clearance or caulking the joining portion, welding such as TIG welding, fixation under pressure, soldering or the like can be performed.

At the overhanging portion 410 serving as the terminal block, concave grooves (not shown) where the center portions of the terminal fittings 8 are respectively disposed are formed. The concave grooves are provided with positioning projections (not shown) for positioning the terminal fittings 8. The terminal fittings 8 are provided with positioning holes (not shown) into which the projections are fitted. The shape, number of pieces and disposition position of the positioning projections and positioning holes are not particularly limited, so long as the terminal fittings 8 can be positioned. The positioning projections and the positioning holes may not be included. Alternatively, the terminal fittings may be provided with such projections and the terminal block may be provided with such holes.

The terminal fittings 8 fitted into the concave groove have their top side covered by the terminal fixing member 9. By the terminal fixing member 9 being tightened by bolts 91, the terminal block is structured. As the constituent material of the terminal fixing member 9, an insulating resin being similar to the material of the side wall portion 41 can be suitably used. Alternatively, a molded product in which the center portions of the terminal fittings 8 are previously covered by insulating resin may be formed, and the molded product may be fixed to the side wall portion 41.

Note that, since the side wall portion 41 is formed by an insulating resin, in place of use of the terminal fixing member 9 and the bolts 91, the side wall portion, the terminal fittings 8, and the terminal block can be integrated by forming the terminal fittings 8 through insert molding. In this mode, fewer numbers of components and assembly steps are required, and hence excellent productivity of the reactor is exhibited.

(Coupling Method)

In order to integrally connect the bottom plate portion 40 and the side wall portion 41 to each other, various fixation members can be used. Exemplary fixation members may be tightening members such as an adhesive agent, bolts and the like. Here, bolt holes (not shown) are provided to the bottom plate portion 40 and the side wall portion 41, and bolts (not shown) are employed as the fixation members. Allowing the bolts to be screwed in, the bottom plate portion 40 and the side wall portion 41 are integrated.

(Joining Layer)

The bottom plate portion 40 includes the joining layer 42 at the place where at least the installed-side face of the coil 2 is brought into contact, at one face disposed on the inner side when the case 4 is assembled.

When the joining layer 42 is formed as a single-layer structure made of an insulating material, formation is facilitated. Furthermore, even with a metal-made bottom plate portion 40, the coil 2 and the bottom plate portion 40 can be insulated from each other. With the joining layer 42 of a multilayer structure made of an insulating material, insulation can be further enhanced. Employing a joining layer of a multilayer structure of an identical material, the thickness per layer can be reduced. By reducing the thickness, even when pinholes exist, insulation can be secured by the adjacent separate layer blocking the pinholes. On the other hand, employing a joining layer of a multilayer structure made of different materials, a plurality of characteristics such as insulation and adhesion between the coil 2 and the bottom plate portion 40, the heat dissipating characteristic from the coil 2 to the bottom plate portion 40 and the like can be obtained. In this case, the constituent material of at least one layer is an insulating material.

The joining layer 42 tends to exhibit higher insulation performance when its total thickness is greater, and to exhibit better heat dissipating performance when its total thickness is smaller. Furthermore, with the smaller total thickness, the interval between the coil 2 and the bottom plate portion 40 is small. Therefore, a small-sized reactor can be obtained. Though it depends on the constituent material, for example, the joining layer 42 may have a total thickness of less than 2 mm; furthermore 1 mm or less; and particularly, 0.5 mm or less. Alternatively, as will be described later, when the joining layer 42 is made of a material exhibiting excellent thermal conductivity, for example, an excellent heat dissipating characteristic can be exhibited even with a total thickness of 1 mm or more. When the joining layer 42 is made of a material of low thermal conductivity (for example, less than 1 W/m·K), an excellent heat dissipating characteristic is exhibited by reducing the total thickness as described above (preferably, 0.5 mm or less). Note that the thickness of the joining layer 42 as used herein refers to the thickness immediately after formation. In some cases, the thickness of the joining layer 42 is reduced after the combined product 10 is placed (for example, approximately 0.1 mm).

The shape of the joining layer 42 is not particularly limited so long as it has an area wide enough at least for the installed-side face of the coil 2 to be fully brought into contact. Here, as shown in FIG. 2, the joining layer 42 conforms to the shape of the installed-side face of the combined product 10, that is, the shape formed by the installed-side face of the coil 2 and that of the outer core portions 32. Accordingly, both the coil 2 and the outer core portions 32 can be fully brought into contact with the joining layer 42.

In particular, when the joining layer 42 has a multilayer structure including an adhesive layer made of an insulating material on the front face side with which the installed-side face of the coil 2 is brought into contact, and a heat dissipation layer exhibiting excellent thermal conductivity on the side with which the bottom plate portion 40 is brought into contact, an excellent heat dissipating characteristic is exhibited. Here, the joining layer 42 has a multilayer structure including an adhesive layer and a heat dissipation layer.

Any material exhibiting excellent adhesion strength can be suitably used for the adhesive layer. For example, the adhesive layer may be made of an insulation adhesive agent, specifically, an epoxy base adhesive agent, an acryl base adhesive agent and the like. The adhesive layer may be formed by, for example, application on the heat dissipation layer, or through screen printing. A sheet-like adhesive agent may be used for the adhesive layer. With the sheet-like adhesive agent, the adhesive layer or the joining layer of the desired shape can be formed with ease irrespective of the single-layer structure or the stacked-layer structure. Here, the adhesive layer has a single-layer structure made of an insulation adhesive agent.

For the heat dissipation layer, a material possessing an excellent heat dissipating characteristic, preferably a material whose thermal conductivity is higher than 2 W/m·K can be suitably used. For the heat dissipation layer, higher thermal conductivity is preferable. It is preferable to be made of a material whose thermal conductivity is 3 W/m·K or more; particularly 10 W/m·K or more; furthermore 20 W/m·K or more; and especially 30 W/m·K or more.

The specific constituent material of the heat dissipation layer may include, for example, a metal material. Though metal materials generally exhibit high thermal conductivity, they are electrically conductive materials. Therefore, it is desired to enhance the insulation performance of the adhesive layer. Further, the heat dissipation layer made of a metal material tends to be heavy. On the other hand, use of a non-metallic inorganic material such as ceramic, being one type of material selected from oxide, carbide, and nitride of metallic element, B, and Si as the constituent material of the heat dissipation layer provides an excellent heat dissipating characteristic and also an excellent electrical insulating characteristic. Therefore, it is preferable. More specific ceramic may be: silicon nitride ($Si_3N_4$) by approx. 20 W/m·K to 150 W/m·K; alumina ($Al_2O_3$) by approx. 20 W/m·K to 30 W/m·K; aluminum nitride (AlN) by approx. 200 W/m·K to 250 W/m·K; boron nitride (BN) by approx. 50 W/m·K to 65 W/m·K; silicon carbide (SiC) by approx. 50 W/m·K to 130 W/m·K. In order to form the heat dissipation layer by those types of ceramic, for example, deposition such as PVD or CVD can be used. Alternatively, the heat dissipation layer can be formed by preparing a sintered plate of the ceramic, and joining the same to the bottom plate portion 40 by any appropriate adhesive agent.

Alternatively, the constituent material of the heat dissipation layer may be an insulating resin (for example, epoxy resin, acrylic resin) containing a filler made of the ceramic noted above. This material provides a heat dissipation layer possessing both an excellent heat dissipating characteristic and an excellent electrical insulating characteristic. Further, in this manner, since both the heat dissipation layer and the adhesive layer are formed by an insulating material, that is, since the entire joining layer is made of an insulating material, the joining layer exhibits further excellent insulating performance. When the insulating resin is made of an adhesive agent, adhesion between the heat dissipation layer and the adhesive layer is excellent, and the joining layer including the heat dissipation layer can strongly join the coil 2 and the bottom plate portion 40 to each other. The adhesive agent forming the adhesive layer and the adhesive agent forming the heat dissipation layer may be of different types. However, when they are of the same type, excellent adhesion can be achieved, and furthermore, formation of the joining layer is facilitated. It is also possible to form the entire joining layer by an insulation adhesive agent containing the filler. In this case, the joining layer has a multilayer structure made of a single type of material.

The heat dissipation layer made of resin containing the filler can be formed with ease by, for example, applying the material to the bottom plate portion 40 or through screen printing.

Alternatively, the heat dissipation layer may be formed by joining a sheet member possessing an excellent heat dissipating characteristic to the bottom plate portion 40 by any appropriate adhesive agent.

The heat dissipation layer may have a single-layer structure or a multilayer structure. When the multilayer structure is employed, the material of at least one layer may be differed. For example, the heat dissipation layer may have a multilayer structure made of materials differing in thermal conductivity from each other.

When the heat dissipation layer is included, since the heat dissipation layer can secure the heat dissipating characteristic, flexibility in selecting usable sealing resin is increased, if a sealing resin is to be in included. For example, resin with poor thermal conductivity such as resin with no filler can be used as the sealing resin.

Here, the heat dissipation layer is formed by an epoxy base adhesive agent (whose thermal conductivity is 3 W/m·K or more) containing a filler made of alumina. Accordingly, here, the entire joining layer is made of an insulation adhesive agent. Further, here, the heat dissipation layer is formed to have a two-layer structure made of the adhesive agent containing the filler, in which the thickness per layer is 0.2 mm, i.e., 0.4 mm in total (the total thickness with the adhesive layer being 0.5 mm) The heat dissipation layer may be made of three or more layers.

[Other Members Stored in Case]

Alternatively, employing the structure in which the back face of one outer core portion 32 is brought into contact with the side wall portion 41 of the case 4, and a member (for example, a leaf spring) that presses the other outer core portion 32 toward the one outer core portion 32 is inserted between the back face of the other outer core portion 32 and the side wall portion 41, it becomes possible to prevent the gap length from being changed by any external factor such as vibrations or a shock. In such a structure in which the pressing member is used, when the gap members 31*g* are each an elastic gap member formed by an elastic material such as silicone rubber, fluororubber and the like, deformation of the gap members 31*g* can adjust the gap length or absorb a certain amount of dimension error.

Further, other than the temperature sensor, a plurality of types of physical quantity measuring sensors, such as a current sensor, can be stored in the case 4. In the case where a plurality of sensors are included, a plurality of line hooking portions and connector hooking portions may be provided at the side wall portion.

[Sealing Resin]

The case 4 may be packed with a sealing resin (not shown) being an insulating resin. In this case, the ends of the wire 2*w* are exposed outside the sealing resin, such that the ends of the wire 2*w* and the terminal fittings 8 can be joined to each other through welding or soldering. Alternatively, the sealing resin may be packed after joining such as the welding is performed, so as to bury the ends of the wire 2*w* and the terminal fittings 8. The packing amount of the sealing resin can be selected as appropriate. The entire surface of top face of the coil 2 may be buried by the sealing resin. Alternatively, the top face may be exposed outside the sealing resin.

The exemplary sealing resin may include epoxy resin, urethane resin, silicone resin and the like. Further, employing a sealing resin containing a filler being excellent in insulating performance and thermal conductivity, for example a filler made of at least one type of ceramic selected from silicon nitride, alumina, aluminum nitride, boron nitride, mullite, and silicon carbide, the heat dissipating characteristic can further be enhanced.

When the case 4 is to be packed with a sealing resin, a gasket 6 may be provided in order to prevent uncured resin from leaking from the clearance between the bottom plate portion 40 and the side wall portion 41. Here, the gasket 6 is an annular element of the dimension with which the gasket 6 can be fitted to the outer circumference of the combined product 10 made up of the coil 2 and the magnetic core 3. Though the gasket 6 made of synthetic rubber is employed, any appropriate material can be used. On the installation side of the side wall portion 41 of the case 4, a gasket groove (not shown) in which the gasket 6 is disposed is provided. When the bottom plate portion 40 and the side wall portion 41 are to be integrated by an adhesive agent, the bottom plate portion 40 and the side wall portion 41 can be closely bonded to each other by the adhesive agent. This feature also contributes toward preventing leakage of the sealing resin and, therefore, the gasket 6 can be dispensed with.

<<Manufacture of Reactor>>

The reactor 1A structured as described above can be representatively manufactured by the following procedure: preparation of the combined product 10, preparation of the side wall portion 41, and preparation of the bottom plate portion 40⇒ fixation of the coil 2⇒ disposition of the side wall portion 41⇒ assembly of the case 4⇒ joining of the terminal fittings and the wire 2*w*⇒ fixing of the connector portion 72, disposition of the sensor 7, and hooking of the line 71 (⇒ packing of the sealing resin).

[Preparation of Combined Product]

Firstly, a description will be given of the preparation procedure of the combined product 10 made up of the coil 2 and the magnetic core 3. Specifically, as shown in FIG. 4, the inner core portions 31 each made up of the stacked core pieces 31*m* and gap members 31*g*, and the one divided piece 50*a* of the insulator 5 are inserted into the coil elements 2*a* and 2*b*. Here, the outer circumference face of the lamination product made up of the core pieces 31*m* and the gap member 31*g* is continuously joined by the adhesion tape, to form each columnar inner core portion 31. Next, to the other ends of the coil elements 2*a* and 2*b*, the other divided piece 50*b* of the insulator 5 is inserted. At this time, the support portions 51*b* of the divided piece 50*b* can be used as the guide. Note that, it is also possible not to integrate the core pieces 31*m* and the gap members 31*g* by an adhesion tape, an adhesive agent or the like, and leave them in the state being separated from one another. In this case, part of the core pieces 31*m* and gap members 31*g* should be supported by the one divided piece 50*a*, and the other core pieces 31*m* and the gap members 31*g* should be supported by the other divided piece 50*b*, to be inserted into the coil elements 2*a* and 2*b*. By allowing the concave and convex of the support portions 51*a* and 51*b* of the divided pieces 50*a* and 50*b* to be engaged with each other, the divided pieces 50*a* and 50*b* are positioned relative to each other.

Next, the outer core portions 32 are disposed so as to clamp the frame plate portions 52 of the insulator 5, to thereby form the combined product 10. At this time, the end faces 31*e* of the inner core portions 31 are exposed by the opening portions of the frame plate portions 52, to be brought into contact with the inner end faces 32*e* of the outer core portions 32. Between the coil elements 2*a* and 2*b*, the partition portions 53*a* and 53*b* of the insulator 5 are interposed. Further, by the storage forming portions 54*a* and 54*b* of the partition portions 53*a* and 53*b*, the space serving as the storage portion of the sensor 7 (FIG. 5) is formed.

[Preparation of Side Wall Portion]

In the concave grooves of the side wall portion 41 formed into a prescribed shape through injection molding or the like, the terminal fittings 8 and the terminal fixing member 9 are disposed in order. Then, the bolts 91 are tightened, to prepare the side wall portion 41 to which the terminal fittings 8 are fixed, as shown in FIG. 2. It is also possible to prepare the terminal fittings 8 being integrally molded with the side wall portion, as has been described above.

[Preparation of Bottom Plate Portion, Fixation of Coil]

As shown in FIG. 2, an aluminum alloy plate is punched into a prescribed shape, to form the bottom plate portion 40. The joining layer 42 of a prescribed shape is formed on one face of the bottom plate portion 40 (here, through screen printing). Thus, the bottom plate portion 40 provided with the joining layer 42 is prepared. Here, the joining layer 42 can be formed in the state where the side wall portion 41 is removed. Accordingly, formation work of the joining layer 42 can be carried out with ease, and excellent workability is exhibited. Then, the assembled combined product 10 is placed on the joining layer 42. Thereafter, the joining layer 42 is cured as appropriate, to thereby fix the combined product 10 to the bottom plate portion 40.

The joining layer 42 allows the coil 2 to be closely bonded to the bottom plate portion 40, and fixes the position of the coil 2 and the outer core portions 32 relative to each other. Hence, the position of the inner core portions 31 clamped between the pair of outer core portions 32 is also fixed. Accordingly, even if the inner core portions 31 and the outer core portions 32 are not joined to each other by an adhesive agent, or the core pieces 31*m* and the gap members 31*g* are not joined to one another by an adhesive agent or an adhesion tape so as to be integrated, the joining layer 42 makes it possible to annularly integrate the magnetic core 3 including the inner core portions 31 and the outer core portions 32. Further, since the joining layer 42 is made of an adhesive agent, the combined product 10 is strongly fixed to the joining layer 42.

Though the joining layer 42 may be formed immediately before disposition of the combined product 10, it is also possible to use the bottom plate portion 40 to which the joining layer 42 is previously formed. In the latter case, a release paper should be previously disposed in order to prevent attachment of foreign objects to the joining layer 42, until the combined product 10 is disposed. It is also possible to previously form solely the heat dissipation layer, and solely the adhesive layer may be formed immediately before the combined product 10 is disposed.

[Disposition of Side Wall Portion]

The side wall portion 41 provided with the terminal fittings 8 is placed from above the combined product 10 so as to surround the outer circumference face of the combined product 10, and disposed on the bottom plate portion 40. As described above, when the side wall portion 41 is placed from above the combined product 10, the overhanging portions 410 of the side wall portion 41 respectively cover the trapezoidal-shaped faces, which are disposed on the top side of the outer core portions 32 of the combined product 10. The overhanging portions 410 serve as the stopper by covering the outer core portions 32, and thus function to position the side wall portion 41 relative to the combined product 10. The side wall portion 41 may be previously disposed around the combined product 10, and then the terminal fittings 8 may be fixed to the side wall portion 41.

[Assembly of Case]

Here, the bottom plate portion 40 and the side wall portion 41 are integrated with each other through use of separately prepared bolts (not shown). Through this step, the box-like case 4 as shown in FIG. 1 is assembled, and the state where the combined product 10 is stored in the case 4 can be achieved. Further, the state where the joining portions 81 of the terminal fittings 8 and the ends of the wire 2*w* are disposed to oppose to each other, and the state where the line hooking portion 55 of the insulator 5 is disposed between and above the coil elements 2*a* and 2*b* can be achieved. From the foregoing procedure, the reactor 1A with no sensor 7 is formed.

[Joining of Terminal Fitting and Wire]

The ends of the wire 2*w* and the joining portions 81 of the terminal fittings 8 are joined through welding, soldering, fixation under pressure or the like, to thereby electrically connect the ends of the wire 2*w* and the joining portions 81 of the terminal fittings 8 to each other. Note that joining of the terminal fittings 8 and the wire 2*w* may precede fixation of the connector portion 72, disposition of the sensor 7, and hooking of the line 71, whose the description will follow, and vice versa.

[Fixation of Connector Portion, Disposition of Sensor, and Hooking of Line]

Any of fixation of the connector portion 72, storing of the sensor 7, hooking of the line 71 may precede the others. However, as will be described later, when fixation of the connector portion 72 is performed before storing of the sensor 7 and hooking of the line 71 are performed, the sensor 7 will not easily be displaced and the state where the sensor 7 is disposed at a prescribed position can be maintained with ease. Therefore, firstly, the connector portion 72 coupled to the sensor 7 is hooked on the connector hooking portion 44 of the side wall portion 41 of the case 4. Here, as described above, the connector portion 72 is slid on the slider stage 441 from the near side to the depth side in FIGS. 2 and 3 (A), such that the opening side of the connector portion 72 is positioned on the near side and the coupled side of the line 71 is on the leading side. Thus, the projection 722 (FIG. 3 (B)) is hooked on the hook 442 (FIG. 3 (A)).

Next, the sensor 7 is inserted to be disposed in the space (storage portion) formed by the storage forming portions 54*a* and 54*b* (FIG. 5 (B)) of the divided pieces 50*a* and 50*b* of the insulator 5. At this time, as shown in FIG. 5 (B), the sensor 7 is inserted while using the end face of the partition portion 53*b* of the other divided piece 50*b* of the insulator 5 as the stopper. As has been described, the sensor 7 inserted into the storage portion is disposed so as to be inclined relative to the direction being perpendicular to both the laterally juxtaposed direction of the coil elements 2*a* and 2*b* and the axial direction thereof (the top-bottom direction in FIG. 5 (B)), and in accordance with the inclination of the storage forming portions 54*a* and 54*b* of the partition portions 53*a* and 53*b*.

Then, the line 71 coupled to the sensor 7 is hooked on the line hooking portion 55 of the insulator 5 and the line hooking portion 43 of the side wall portion 41 of the case 4. Here, allowing the line 71 to be hooked on a plurality of line hooking portions 55 and 43, the line 71 can be more surely fixed. Further, employing the structure in which the line 71 is folded back from the insertion direction of the sensor 7 and routed to be hooked as described above, even when the line 71 is pulled in the direction in which the sensor 7 comes off, the partition portion 53*b* of the other divided piece 50*b* of the insulator 5 serves as the stopper and prevents the sensor 7 from coming off from the storage portion. From the foregoing procedure, the reactor 1A with no sealing resin is formed. Note that, the sensor 7 can be stored while the line 71 is being hooked on the hooking portions 55 and 43.

[Packing of Sealing Resin]

By allowing the case 4 to be packed with a sealing resin (not shown) and to be cured, a reactor having a sealing resin can be formed. In this mode, both the sensor 7 and the line 71 can be fixed with a sealing resin. Since the line 71 and the connector portion 72 are hooked on the hooking portions 55, 43 and 44 as described above, the line 71 or the connector portion 72 will not become an obstacle when the resin is packed. Note that, in this mode, joining of the terminal fittings 8 and the ends of the wire 2*w* may be performed after the sealing resin is packed.

<<Application>>

The reactor 1A structured as described above can be suitably used for applications in which the energizing conditions are, for example: the maximum current (direct current) is approx. 100 A to 1000 A; the average voltage is approx. 100 V to 1000 V; and the working frequency is approx. 5 kHz to 100 kHz. Representatively, the reactor 1A can be suitably used for a constituent component of an in-vehicle power converter apparatus for an electric vehicle, a hybrid vehicle and the like.

<<Effect>>

In connection with the reactor 1A structured as described above, allowing the connector portion 72 coupled to the sensor 7 to be hooked on the connector hooking portion 44 provided at the side wall portion 41 of the case 4, the connector portion 72 can be restricted from shifting, and the connector portion 72 and the connector portion of an external apparatus can be connected to each other in a stable manner. Further, in connection with the reactor 1A, the connector portion 72 is fixed to the case 4. Thus, when the connector portion 72 is pulled, any possible displacement, coming off, damage or the like that may otherwise be done to the sensor 7 as a result of the line 71 and the sensor 7 being also pulled can be prevented. In particular, since the connector hooking portion 44 is integrated with the case 4, no separate member is required in fixing the connector portion 72, and an increase in the number of components of the reactor 1A will not be invited. Further, since the side wall portion 41 is made of resin, the connector hooking portion 44 can also be formed through injection molding or the like with ease.

Further, since the reactor 1A includes, in addition to the connector hooking portion 44, the line hooking portion 43 on which the line 71 of the sensor 7 can be hooked at the side wall portion 41 of the case 4 and allows the line 71 to be hooked, the line 71 can be restricted from shifting. Thus, displacement, coming off, or any damage which may otherwise be done to the sensor 7 as a result of routing of the line 71 can be effectively prevented. Further, even when the line 71 has a redundant length, the possibility of the line 71 itself being roughly routed and tangled can be reduced. In addition, the reactor 1A includes the line hooking portion not only at the case 4 but also at the insulator 5 as the line hooking portion 55. Thus, the line 71 can be restricted from shifting by a plurality of line hooking portions 43 and 55. This feature also contributes toward effectively preventing the sensor 7 from being displaced or coming off. Accordingly, the reactor 1A can maintain the sensor 7 at a prescribed position for a long period. Further, with the reactor 1A, the desired physical quantity (here, the temperature of the coil 2) can be properly measured by the sensor 7 disposed at a prescribed position, and feedback control or the like can be performed in an excellent manner based on the measured physical quantity.

Further, with the reactor 1A, since the insulator 5 is provided with the storage portion for the sensor 7, the sensor 7 can be easily positioned at a prescribed position. Accordingly, in connection with the reactor 1A, the sensor 7 can be positioned properly at a prescribed position and, furthermore, the disposition position can be maintained for a long period thanks to provision of the connector hooking portion 44 and the line hooking portion 43.

Further, since the line hooking portions 43 and 55 are respectively integrally molded with the side wall portion 41 of the case 4 and the insulator 5 themselves, the number of components is fewer as compared to the case where the line hooking portions are separate members. Furthermore, since the line hooking portions 43 and 55 can be molded with ease through injection molding or the like of resin, excellent productivity is exhibited with the reactor 1A.

In addition, the reactor 1A according to the first embodiment exhibits the following effects.

(1) Thanks to provision of the case 4, the combined product 10 can be protected from the external environment and can be mechanically protected.

(2) Despite provision of the case 4, the reactor 1A is lightweight because the side wall portion 41 is made of resin (in particular, an insulating resin). In addition, the interval between the outer circumference face of the coil 2 and the inner circumference face of the side wall portion 41 can be narrowed as compared to the case where the side wall portion made of an electrically conductive material is used. Therefore, the reactor can be small in size.

(3) Provision of the insulator 5 enhances insulation between the coil 2 and the magnetic core 3.

(4) Since the joining layer 42, which includes the heat dissipation layer exhibiting excellent thermal conductivity, i.e., higher than 2 W/m·K, is interposed between the bottom plate portion 40 made of a metal material and the coil 2, during operation, heat from the coil 2 and the magnetic core 3 can be efficiently transferred to an installation target such as a cooling base via the bottom plate portion 40 and the heat dissipation layer. Accordingly, an excellent heat dissipating characteristic is exhibited irrespective of presence of a sealing resin or the material of the sealing resin. When the entire joining layer 42 is made of an insulating material whose thermal conductivity is higher than 2 W/m·K, a reactor possessing an even excellent heat dissipating characteristic can be obtained.

(5) Since the bottom plate portion 40 being brought into contact with the coil 2 is made of a material exhibiting excellent thermal conductivity such as aluminum, an even excellent heat dissipating characteristic is exhibited.

(6) Though the bottom plate portion 40 is made of a metal material (an electrically conductive material), since at least the in-contact place of the joining layer 42 relative to the coil 2 is made of an insulating material, insulation between the coil 2 and the bottom plate portion 40 can be secured even when the joining layer 42 is very thin, e.g., as thin as 0.1 mm. In particular, in this example, since the entire joining layer 42 is made of an insulating material, the coil 2 and the bottom plate portion 40 can be fully insulated from each other even when the joining layer 42 is thin.

(7) Thanks also to the joining layer 42 being thin, heat from the coil 2 and the like can be transferred with ease to the installation target via the bottom plate portion 40. Hence, the reactor 1A possesses an excellent heat dissipating characteristic.

(8) Since the entire joining layer 42 is made of an insulating adhesive agent, excellent adhesion between the coil 2 or the magnetic core 3 and the joining layer 42 is achieved. This feature also facilitates transfer of heat from the coil 2 and the like to the joining layer 42, and hence the reactor 1A possesses an excellent heat dissipating characteristic.

(9) Use of a coated rectangular wire as the wire 2*w* secures a fully wide contact area between the coil 2 and the joining layer 42. This feature also contributes to the reactor 1 possessing an excellent heat dissipating characteristic.

(10) Thanks also to the joining layer 42 being thin, the interval between the coil 2 and the bottom plate portion 40 can be narrowed, and hence the reactor 1 is small in size.

(11) The structure in which the bottom plate portion 40 and the side wall portion 41 are separate members independent of each other, which are to be combined and integrated by fixation members. Accordingly, despite provision of the connector hooking portion 44 and the line hooking portion 43, the combined product 10 can be stored in the case 4 with ease.

(12) Since the joining layer 42 can be formed at the bottom plate portion 40 in the state where the side wall portion 41 is removed, the joining layer 42 can be formed with ease. Thus, excellent productivity is exhibited.

First Variation

In the first embodiment described above, a description has been given of the mode in which the insulator 5 is structured by a pair of divided pieces 50*a* and 50*b* that can be divided in the axial direction of the coil 2. Alternatively, the mode in which the frame plate portion and the sleeve-like portion are separate members can be employed. When the sleeve-like portion is structured by, for example combining a pair of members having ]-shaped cross section that can be divided in the top-bottom direction to obtain a sleeve-like shape, the sleeve-like portion can be disposed at the outer circumference of each inner core portion 31 with ease, and excellent assemblability is exhibited. When the members structuring the sleeve-like portion are each provided with an engaging portion, positioning relative to each other can be performed with ease. However, the sleeve-like portion is not necessarily the integrated ]-shaped members so long as a prescribed distance can be maintained between the coil elements and the inner core portions. Further, as described above, the sleeve-like portion may be structured by an insulating tubing or the like. On the other hand, when the paired frame plate portions are respectively provided with the partition portions 53*a* and 53*b* as in the first embodiment, the storage portion for the sensor and the line hooking portion can be formed, and additionally, the coil elements can be insulated from each other.

Second to Fifth Embodiments

In the following, with reference to FIGS. 7 to 9, a description will be given of reactors 1B to 1E according to the second to fifth embodiments. The basic structure of the reactors 1B to 1E is similar to the reactor 1A according to the first embodiment, and differences lie in the structure relating to the connector hooking portion 44. In the following, the description will be given solely of the differences, and the structures and effects that are similar to those of the first embodiment will not be described. Note that, the reactor 1D shown in FIG. 8 (B) corresponds to the disposition state of the reactor 1A and others shown in FIG. 1 and others being rotated by 180°, such that the terminal block portion including the terminal fittings 8 is disposed on the right side.

Figure 7:
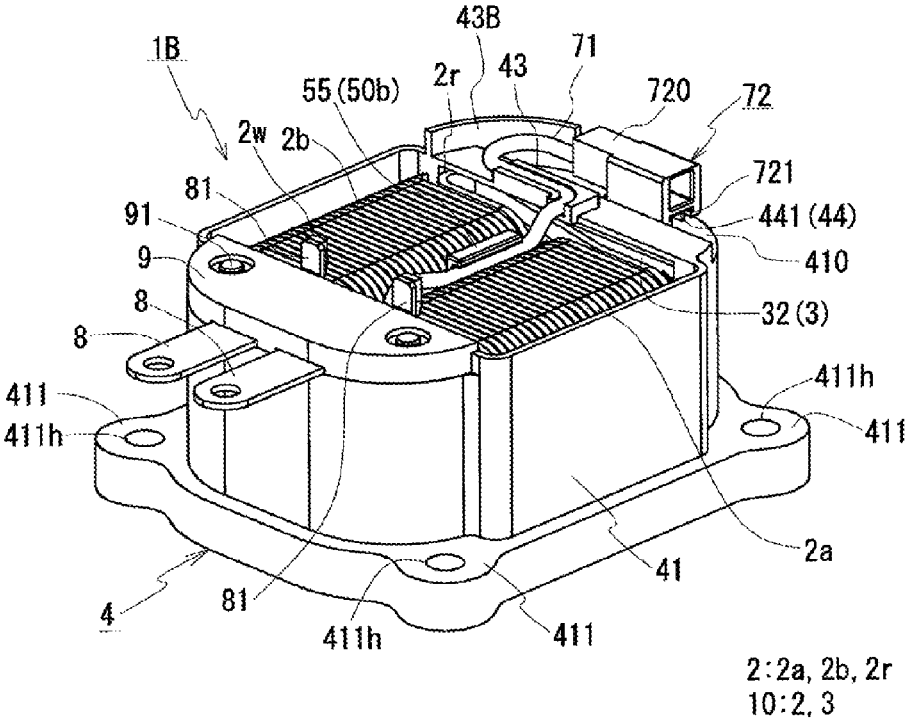
FIG. 7 is a schematic perspective view of a reactor according to a second embodiment.

The reactor 1B according to the second embodiment shown in FIG. 7 is different in that it further includes a line wall 43B at the overhanging portion 410 where the connector hooking portion 44 is provided, in the side wall portion 41 included in the reactor 1A according to the first embodiment. The line wall 43B is structured by a plate-like member, and integrally molded with the side wall portion 41, so as to project upward in FIG. 7 from part of the periphery of the overhanging portion 410. Further, the line wall 43B is provided so as to curve along the periphery of the overhanging portion 410.

Here, with the reactors 1A and 1B according to the first and second embodiments, the portion of the line 71 that exits from the line hooking portion 43 of the side wall portion 41 and is connected to the end of the connector portion 72 is disposed as being bent in a U-shape. The line wall 43B is disposed to surround the outer side of the U-shaped portion, to thereby provide the U-shaped portion of the line 71 with mechanical protection and prevent disturbance in the disposition state. The formation length, projection height, and formation position of the line wall 43B can be designed as appropriate in accordance with the diameter of the line 71 or the disposition position of the line 71. Further, since the line wall 43B is provided only at the place where the line 71 is disposed, it will not become an obstacle when the connector portion 72 and the connector portion of an external apparatus are connected to each other. Thus, the connection work can be performed with ease.

The reactor 1C according to the third embodiment shown in FIG. 8 (A) and the reactor 1D according to the fourth embodiment shown in FIG. 8 (B) are different from the reactor 1A according to the first embodiment in the disposition position of the connector hooking portion 44. Further, the third embodiment is different from the reactor 1A according to the first embodiment in the shape and disposition position of the line hooking portion 43. The fourth embodiment is different from the reactor 1A according to the first embodiment in that it further includes a line hooking portion 43D. As described above, since the side wall portion 41 is made of resin, the disposition position of the connector hooking portion 44 and the shape, disposition position and the number of pieces of the line hooking portion 43 (43D) can be changed with ease.

With the reactor 1C according to the third embodiment, the connector hooking portion 44 and the line hooking portion 43 are provided not on the overhanging portion 410 of the side wall portion 41 but at the outer circumference face (the near side face in FIG. 8 (A)) of the side wall portion 41. More specifically, at the region on the terminal block side (the left near side in FIG. 8 (A)) to which the terminal fittings 8 are fixed in the outer circumference face of the side wall portion 41, the straight line hooking portion 43 is provided in the direction perpendicular (the top-bottom direction in FIG. 8 (A)) to the axial direction of the coil 2. Further, at the portion in a stepped shape on the installation side (the bottom side in FIG. 8 (A)) of the side wall portion 41 (here, on the step), the connector hooking portion 44 is provided. Then, with the reactor 1C, the line 71 coupled to the sensor (see FIG. 5 and others) stored in the storage portion (see FIG. 5 and others) of the sensor formed by the insulator (see FIG. 5 and others) is not hooked on the line hooking portion 55 provided at the divided piece 50*b* but is disposed on the terminal block side. Part of the line 71 is held by the straight line hooking portion 43, and other portion exiting from the line hooking portion 43 is bent in the horizontal direction (the right-left direction in FIG. 8 (A)) and connected to the connector portion 72. The connector hooking portion 44 is provided such that part of the connector portion 72 hooked on the hooking portion 44 is held by the stepped portion of the side wall portion 41.

An upper space at the portion along the step formed by the coil 2 and the outer core portion 32 in the region on the opening side of the side wall portion 41 is a dead space. Further, in the installation side region of the side wall portion 41, an upper space at the portion in a stepped shape covering the stepped portion formed by the combined product 10 and the bottom plate portion (see FIG. 2 and others) is also a dead space. With the reactor 1C, the connector hooking portion 44 and the line hooking portion 43 are provided such that at least part of the line 71 and at least part of the connector portion 72 are stored in those dead spaces. Hence, since the dead spaces can be effectively used, a reduction in size can be achieved. Further, since the connector hooking portion 44 is provided such that the opening portion of the connector portion 72 fixed to the connector hooking portion 44 is oriented in the direction other than the installation side (here, the right side), with the reactor 1C, the work of connecting the connector portion 72 and the connector portion of an external apparatus to each other can be performed also with ease. Hence, excellent workability is exhibited.

The reactor 1D according to the fourth embodiment shown in FIG. 8 (B) includes the line hooking portion 43 provided with an L-shaped groove on the overhanging portion 410 of the side wall portion 41. Further, similarly to the reactor 1C according to the third embodiment, the reactor 1D further includes the straight line hooking portion 43D in a dead space (the portion covering the stepped portion formed by the end face of the coil 2 and the outer core portion 32) of the outer circumference face of the side wall portion 41. However, the reactor 1D includes the line hooking portion 43D not in the dead space on the terminal block side but in the dead space on the coil couple portion side (the left near side in FIG. 8 (B)). In this manner, the side wall portion 41 may be provided with a plurality of line hooking portions. Further, similarly to the reactor 1C according to the third embodiment, the reactor 1D includes a connector hooking portion (which is hidden behind the connector portion 72 in FIG. 8 (B)) in the dead space (the stepped portion formed by the installation side region of the side wall portion 41 and a portion covering the combined product 10 (the outer core portion 32)) at the outer circumference face of the side wall portion 41. The connector hooking portion is provided such that the opening portion (the portion coupled to the connector portion of an external apparatus) of the connector portion 72 hooked on the connector hooking portion is oriented upward.

With the reactor 1D shown in FIG. 8 (B), the line 71 hooked on the line hooking portion 55 of the insulator and then exiting from the line hooking portion 43 of the overhanging portion 410 is bent downward. Part of the line 71 is then hooked on the line hooking portion 43D, while the other portion of the line 71 are bent in a U-shape and disposed. The connector portion 72 connected to the line 71 is fixed to the connector hooking portion such that its opening portion is oriented upward, as described above.

Similarly to the reactor 1C according to the third embodiment, with the reactor 1D, the dead space of the side wall portion 41 can be effectively used, and a reduction in size can be achieved. Furthermore, the work of connecting the connector portion 72 and the connector portion of the external apparatus to each other can be performed with ease.

With the reactors 1C and 1D according to the third and fourth embodiments shown in FIG. 8 also, when the sensor is stored after the connector portion 72 is hooked on the connector hooking portion 44, or after the line 71 is hooked on the line hooking portions 43 and 43D, the sensor will not displace easily.

Figure 9:
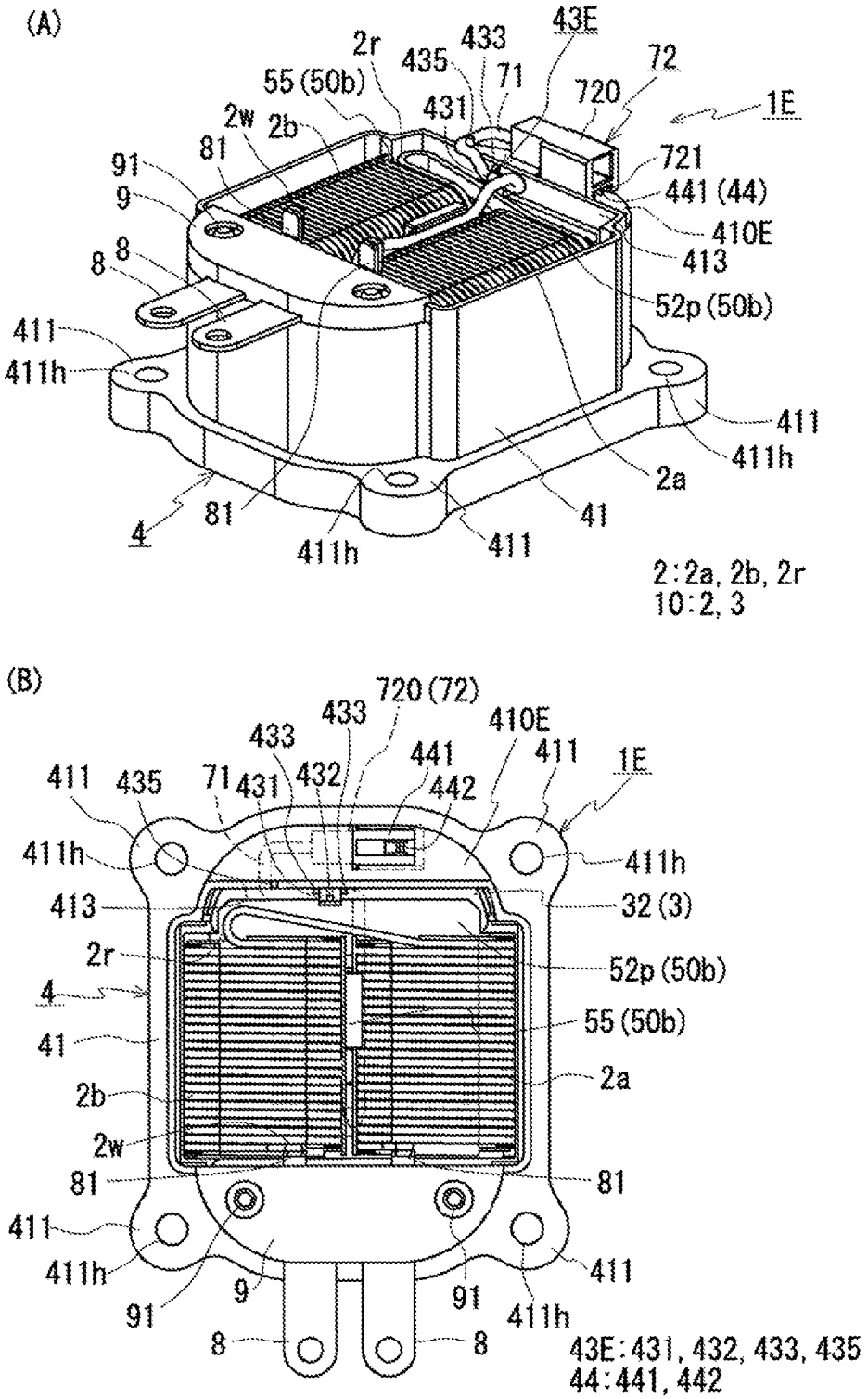
FIG. 9 (A) is a schematic perspective view of a reactor according to a fifth embodiment, and FIG. 9 (B) is a schematic plan view of the reactor according to the fifth embodiment.

The reactor 1E according to the fifth embodiment shown in FIG. 9 is different from the first embodiment in that: an overhanging portion 410E provided with the connector hooking portion 44 on which the connector portion 72 is hooked is smaller than the overhanging portion 410 included in the reactor 1A according to the first embodiment; the opening portion of the side wall portion 41 included in the reactor 1E is greater than in the first embodiment; and the shape of a line hooking portion 43E is different from the first embodiment. A pair of overhanging portions 410 included in the reactor 1A according to the first embodiment substantially covers a pair of outer core portions 32 structuring the magnetic core 3. On one overhanging portion 410, both the line hooking portion 43 (L-shaped groove) and the connector hooking portion 44 are provided. With the reactor 1E according to the fifth embodiment, one overhanging portion 410E covers only part of one trapezoidal-shaped face of the one outer core portion 32, and has an area with which only the connector hooking portion 44 can be formed, with no line hooking portion 43 (L-shaped groove). Accordingly, with the reactor 1E, as shown in FIG. 9 (B), in the combined product 10 made up of the coil 2 and the magnetic core 3, the coil elements 2*a* and 2*b*, the coil couple portion 2*r*, and other part of the trapezoidal-shaped face of the one outer core portion 32 are exposed in the opening portion of the side wall portion 41.

The overhanging portion 410E corresponds to the overhanging portion 410 included in the reactor 1A according to the first embodiment from which the plate-like portion structuring the portion where the line hooking portion 43 is provided is removed. As shown in FIG. 9 (A), the overhanging portion 410E is L-shaped. More specifically, the overhanging portion 410E includes a plane portion covering part of the trapezoidal-shaped face of the one outer core portion 32, and a wall portion 413 standing upright from the plane portion (standing upward in FIG. 9 (A)). Then, the reactor 1E includes, as the line hooking portion 43E, an L-shaped portion 431 projecting from the inner face of the wall portion 413 to the coil 2 side, a projection 432 projecting from one face of the L-shaped portion 431, two projections 433 projecting from the inner face of the wall portion 413 toward the coil 2, to oppose to the one face of the L-shaped portion 431, and a rod-like element 435 provided to stand upright from the end face (the top face in FIG. 9 (A)) of the wall portion 413. The one face of the L-shaped portion 431 (hereinafter referred to as the projection forming face) is provided to be in parallel to the inner face of the wall portion 413. The interval between the projection forming face and the inner face of the wall portion 413 (the width of the other face (hereinafter referred to as the coupling face) connected to the wall portion 413 in the L-shaped portion 431) has the size corresponding to the diameter of the line 71. The two projections 433 provided to project from the inner face of the wall portion 413 are disposed to be away from each other, so as to clamp the projection 432. The rod-like element 435 is provided at the position being away from the L-shaped portion 432 in the laterally juxtaposed direction of the coil elements 2*a* and 2*b*.

Since the reactor 1E includes the line hooking portion 43E, the line 71 can be hooked thereon similarly to the reactor 1A according to the first embodiment. Specifically, firstly, in the similar manner as in the first embodiment, the connector portion 72 is attached to the connector hooking portion 44 at the overhanging portion 410E. Next, the line 71 connected to the connector portion 72 is hooked on the rod-like element 435 projecting from the wall portion 413. The shape of the rod-like element 435 can be selected as appropriate. Here, the rod-like element 435 is a round rod, whereby the line 71 can be smoothly bent to change the direction of the line 71. Here, the line 71 is bent to be U-shaped so as to conform to the inner face of the wall portion 413, to thereby change the direction of the line 71. Further, this line 71 is fitted between the projections 432 and 433. In this manner, the line 71 has its one portion held by the coupling face of the L-shaped portion 431, and has its other one portion pressed by the projections 432 and 433 toward the coupling face side. Thus, the line 71 is prevented from rising up out of the coupling face. The shape of the projections 432 and 433 can be selected as appropriate. Here, the projections 432 and 433 are each a solid having inclined planes (a triangular prism-like object, or a quadrangular prism-like object with trapezoidal faces). The inclined planes included in the projections 432 and 433 are provided from above to below when the reactor 1E shown in FIG. 9 (B) is seen from right or left. That is, the inclined planes are provided so as to be widen from the opening side of the case 4 toward the bottom side (on the coupling face side of the L-shaped portion 431); the projection 432 is provided at the projection forming face of the L-shaped portion 431, and the projection 433 is provided at the inner face of the wall portion 413. Further, the bottom face of the projection 432 connected to the projection forming face of the L-shaped portion 431, and the bottom face of the projection 433 connected to the inner face of the wall portion 413 are both provided so as to be in parallel to the coupling face of the L-shaped portion 431. With this structure, allowing the line 71 to slide along the inclined plane, the line 71 can be easily stored on the coupling face side in the L-shaped portion 431. Further, the line 71 stored in the L-shaped portion 431 can be pressed by the bottom face of the projection 432 and the bottom face of the projection 433. Thus, these faces function as the pressing portions. Further, the rest of the line 71 is disposed toward the end portion side of the wire 2*w* from the coil couple portion 2*r* side while bridging the coil couple portion 2*r*. Then, the line 71 is bent at an appropriate angle on the end side of the wire 2*w* downward, and the sensor (not shown) is disposed between the coil elements 2*a* and 2*b*. In this manner, with the reactor 1E also, disposition of the sensor, hooking of the line 71, and hooking of the connector portion 72 can be performed. Note that the intermediate portion of the line 71 may be hooked on the line hooking portion 55 of the insulator.

Since the reactor 1E according to the fifth embodiment includes the line hooking portion 43E having a plurality of projections 432 and 433 and the rod-like element 435, the line 71 can be fixed to the case 4 similarly to the reactor 1A according to the first embodiment, despite the absence of the groove for continuously holding part of the line 71. Further, since also the reactor 1E includes, in addition to the line hooking portion 43E provided at the case 4, the line hooking portion 55 at the insulator, the hooking portions of the line 71 are fully great in number, and the line 71 can be strongly fixed with ease. Further, with the reactor 1E according to the fifth embodiment, since the opening portion of the case 4 storing the combined product 10 is great as compared to the reactor 1A according to the first embodiment (i.e., since the overhanging portion 410E is small), for example when a sealing resin is to be included, the sealing resin can be packed with ease. Hence, excellent workability is exhibited.

Second Variation

In the first embodiment, a description has been given of the structure in which the insulator 5 includes the storage portion for the sensor 7. In another possible structure, the side wall portion of the case may include the storage portion for the sensor 7. That is, the storage portion of the sensor 7 may be integrally molded with the side wall portion by the resin structuring the side wall portion.

Specifically, a cross-shaped bridge portion is integrally molded so as to bridge between opposing peripheral sides, in the peripheral sides of the quadrangle structuring the opening portion of the side wall portion. The cross-shaped intersection portion is provided with a bottomed tubular element extending downward in the top-bottom direction, so as to be inserted between the coil elements when the side wall portion is disposed around the coil. Then, the bottomed tubular element is provided with a vertical hole having a diameter enough for the sensor 7 to be inserted. Thus, the bottomed tubular element can be used as the storage portion. Note that, a straight bridge portion may be employed, and the bottomed tubular element serving as the storage portion may be provided at the intermediate portion of the bridge portion. This storage portion can be integrally molded when the side wall portion is molded through injection molding or the like, and hence excellent productivity of the reactor is exhibited.

In this mode, allowing the sensor 7 to be inserted into the vertical hole, an increase in the number of components will not be invited, and the sensor 7 can be disposed at a prescribed position between the coil elements and held thereby. Further, allowing the connector portion 72 of the line 71 connected to the sensor 7 to be hooked on the connector hooking portion provided at the side wall portion, or allowing the line 71 to be hooked on the line hooking portion provided at the side wall portion (for example, the cross-shaped bridge portion or the like), the connector portion 72 and the line 71 can be restricted from shifting. Since this storage portion is made of an insulating resin similarly to the side wall portion, it can also function as a partition portion insulating between the coil elements as being interposed between the coil elements. Accordingly, in this mode, an insulator with no partition portion can be used, and hence the shape of the insulator can be simplified. Alternatively, when restriction of the line 71 from shifting is realized by, e.g., slightly narrowing the opening portion of the vertical hole, the vertical hole itself can function as the line hooking portion. In this case, the line hooking portions at the side wall portion and at the insulator can be dispensed with. Alternatively, in addition to the vertical hole functioning as the line hooking portion, the line hooking portions at the side wall portion and at the insulator can also be provided.

Third Variation

In the first to fifth embodiments, a description has been given of the structure in which the sensor 7 is disposed diagonally relative to the axial direction of the coil 2 (forming an acute angle or an obtuse angle), or disposed perpendicularly relative to the axial direction of the coil 2. Alternatively, the sensor 7 can be disposed along the axial direction of the coil. In this mode, for example a space between the elements 2*a* and 2*b* where the sensor 7 can be disposed is formed by, for example, employing quadrangular plate-like partition portions 53*a* and 53*b*, or dispensing with the partition portions 53*a* and 53*b*. With this mode, the sensor 7 can be disposed at a prescribed position with ease, and excellent workability is exhibited. In this mode also, since the connector portion 72 is fixed to the connector hooking portion, and the line 71 is hooked on the line hooking portion, the disposition position of the sensor 7 can be easily maintained. Note that, since the sensor 7 is disposed in close proximity to the coil 2 in this mode, it is suitable when the sensor 7 is particularly a temperature sensor.

Sixth Embodiment

The reactor according to any of the first to fifth embodiments and the first to third variations may be used, for example, as a constituent component of a converter mounted on a vehicle or the like, or as a constituent component of a power converter apparatus including the converter.

Figure 10:
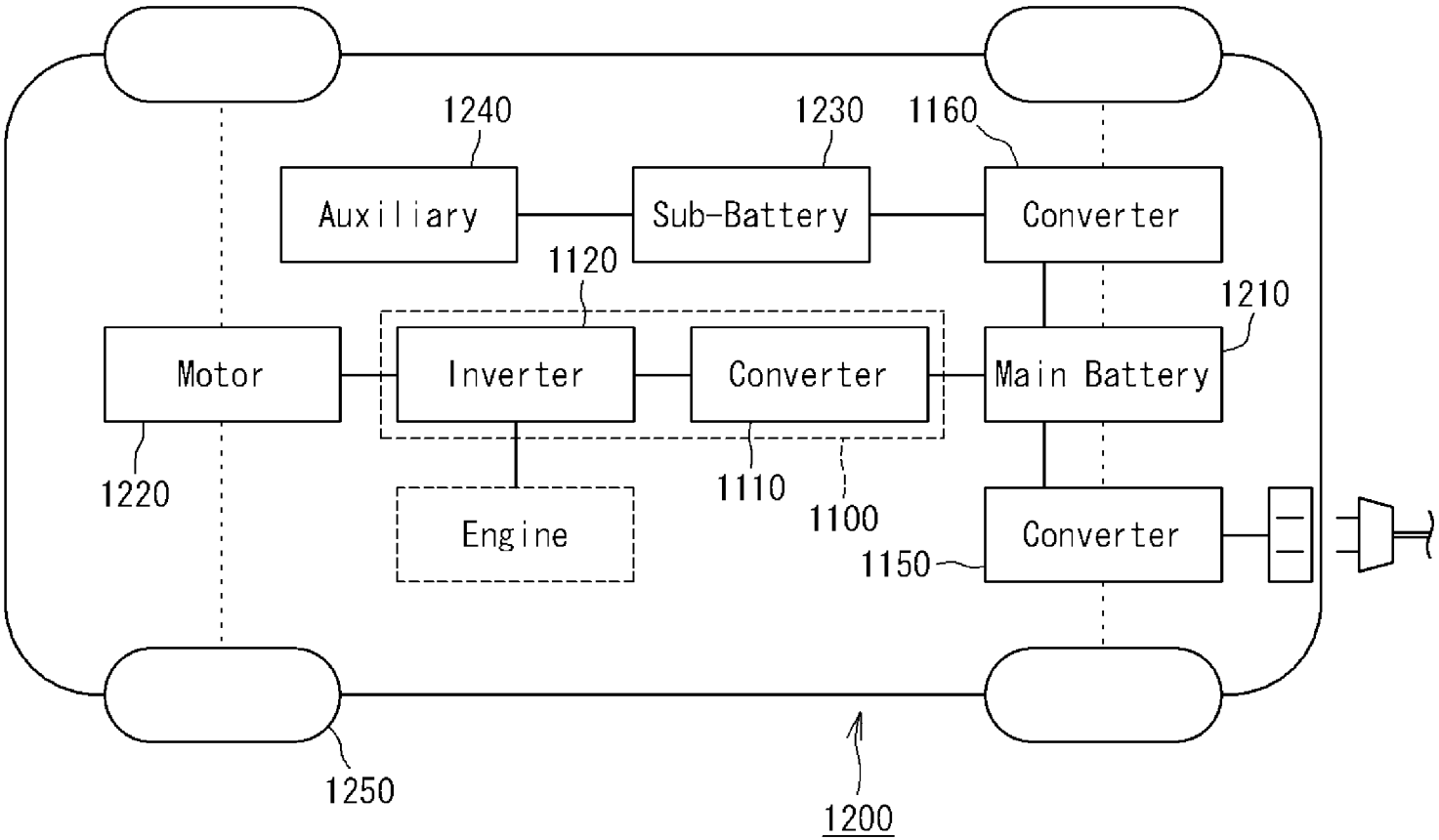
FIG. 10 is a schematic structure diagram schematically showing a power supply system of a hybrid vehicle.

For example, as shown in FIG. 10, a vehicle 1200 such as a hybrid vehicle or an electric vehicle includes a main battery 1210, a power converter apparatus 1100 connected to the main battery 1210, and a motor (a load) 1220 driven by power supplied from the main battery 1210 and serves for traveling. The motor 1220 is representatively a three-phase alternating current motor. The motor 1220 drives wheels 1250 in the traveling mode and functions as a generator in the regenerative mode. In the case of a hybrid vehicle, the vehicle 1200 includes an engine in addition to the motor 1220. Note that, though an inlet is shown in FIG. 10 as a charging portion of the vehicle 1200, a plug may be included.

The power converter apparatus 1100 includes a converter 1110 connected to the main battery 1210, and an inverter 1120 connected to the converter 1110 to perform interconversion between direct current and alternating current. When the vehicle 1200 is in the traveling mode, the converter 1110 shown in this example steps up a DC voltage (input voltage) of about 200 V to 300 V of the main battery 1210 to about 400 V to 700 V, and supplies the inverter 1120 with the stepped up power. Further, in the regenerative mode, the converter 1110 steps down the DC voltage (input voltage) output from the motor 1220 through the inverter 1120 to a DC voltage suitable for the main battery 1210, such that the main battery 1210 is charged with the DC voltage. When the vehicle 1200 is in the traveling mode, the inverter 1120 converts the direct current stepped up by the converter 1110 into a prescribed alternating current and supplies the motor 1220 with the alternating current. In the regenerative mode, the inverter 1120 converts the AC output from the motor 1220 into direct current, and outputs the direct current to the converter 1110.

Figure 11:
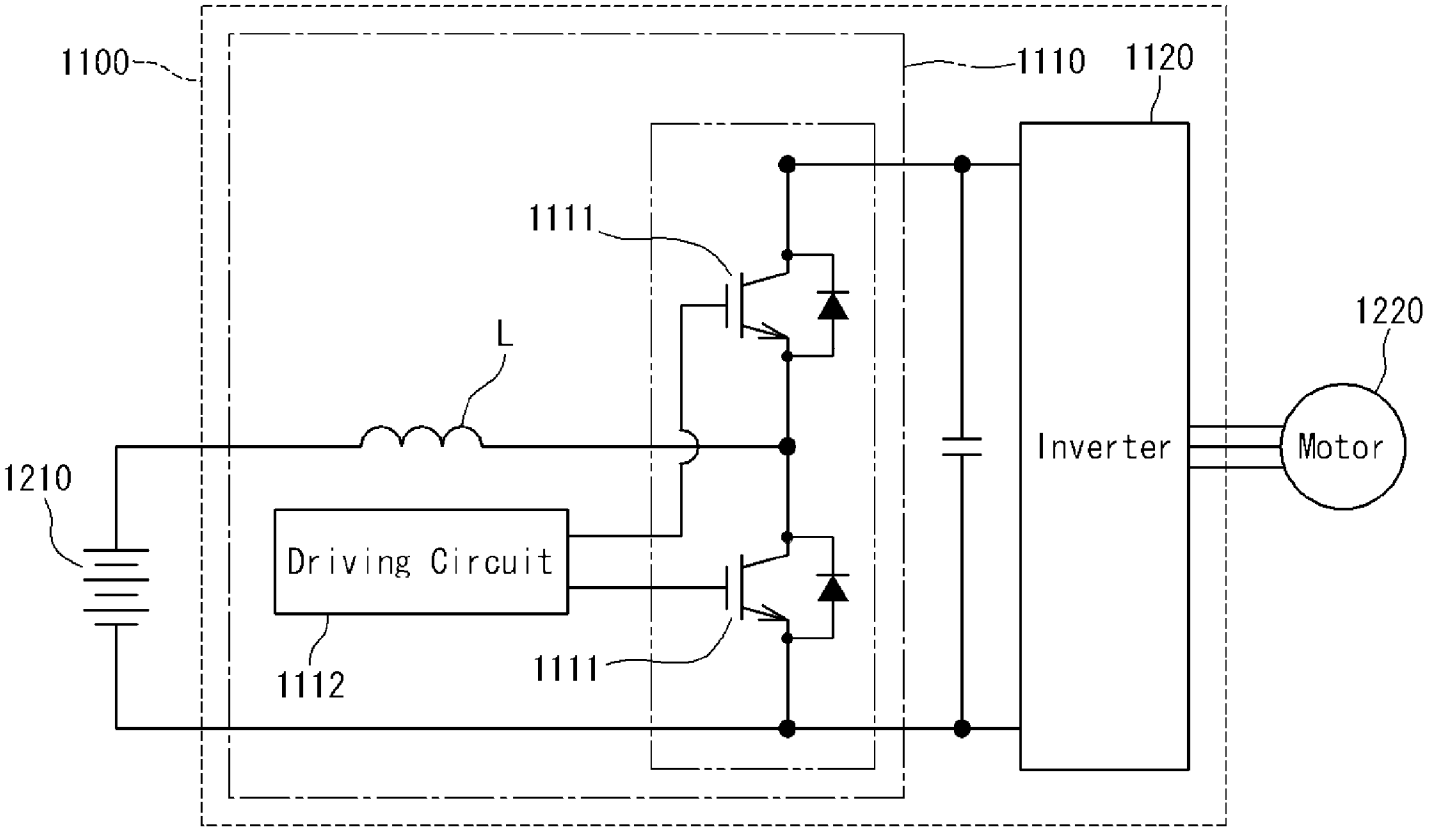
FIG. 11 is a schematic circuit diagram showing an exemplary power converter apparatus of the present invention including a converter of the present invention.

As shown in FIG. 11, the converter 1110 includes a plurality of switching elements 1111, a driver circuit 1112 that controls operations of the switching elements 1111, and a reactor L. The converter 1110 converts (here, performs steps up and down) the input voltage by repetitively performing ON/OFF (switching operations). As the switching elements 1111, power devices such as FETs or IGBTs are used. The reactor L uses a characteristic of a coil that disturbs a change of current which flows through the circuit, and hence has a function of making the change smooth when the current is increased or decreased by the switching operation. The reactor L is the reactor according to any of the first to fifth embodiments and the first to third variations. Since the reactor 1A on which the connector portion 72 of the sensor 7 such as a temperature sensor can be hooked and others are included, with the power converter apparatus 1100 and the converter 1110 also, the sensor 7 and an external apparatus can be connected to each other with ease in a stable manner, and a desired physical quantity can be measured in a stable manner.

Note that the vehicle 1200 includes, in addition to the converter 1110, a power supply apparatus-use converter 1150 connected to the main battery 1210, and an auxiliary power supply-use converter 1160 connected to a sub-battery 1230 serving as a power source of auxiliary equipment 1240 and to the main battery 1210, to convert a high voltage of the main battery 1210 to a low voltage. The converter 1110 representatively performs DC-DC conversion, whereas the power supply apparatus-use converter 1150 and the auxiliary power supply-use converter 1160 perform AC-DC conversion. Some types of the power supply apparatus-use converter 1150 perform DC-DC conversion. For the reactor of each of the power supply apparatus-use converter 1150 and the auxiliary power supply-use converter 1160, a reactor that is structured similarly to the reactor according to any of the first to fifth embodiments and first to third variations can be used, with its size and shape being changed as appropriate. Further, the reactor according to any of the first to fifth embodiments and first to third variations can be used for a converter that performs conversion for the input power and that performs only stepping up or stepping down.

Note that the present invention is not limited to the embodiments described above, and any change can be made within a range not departing from the gist of the present invention.

INDUSTRIAL APPLICABILITY

The reactor of the present invention can be suitably used as a constituent component of a power converter apparatus, such as an in-vehicle converter (representatively a DC-DC converter) mounted on a vehicle such as a hybrid vehicle, a plug-in hybrid vehicle, an electric vehicle, a fuel cell vehicle and the like, or a converter of an air conditioner.

REFERENCE SIGNS LIST

1A, 1B, 1C, 1D, 1E: REACTOR
10: COMBINED PRODUCT
2: COIL
2*a*, 2*b*: COIL ELEMENT
2*r*: COIL COUPLE PORTION
2*w*: WIRE
3: MAGNETIC CORE
31: INNER CORE PORTION
31*e*: END FACE
31*m*: CORE PIECE
31*g*: GAP MEMBER
32: OUTER CORE PORTION
32*e*: INNER END FACE
4: CASE
40: BOTTOM PLATE PORTION
41: SIDE WALL PORTION
42: JOINING LAYER
43, 43D, 43E: LINE HOOKING PORTION
43B: LINE WALL
431: L-SHAPED PORTION
432, 433: PROJECTION
435: ROD-LIKE ELEMENT
44: CONNECTOR HOOKING PORTION
441: SLIDER STAGE
442: HOOK
400, 411: ATTACHING PORTION
400*h*, 411*h*: BOLT HOLE
410, 410E: OVERHANGING PORTION
413: WALL PORTION
5: INSULATOR
50A, 50B: DIVIDED PIECE
51: SLEEVE-LIKE PORTION
51*a*, 51*b*: SUPPORT PORTION
52: FRAME PLATE PORTION
52*p*: PEDESTAL
53*a*, 53*b*: PARTITION PORTION
54*a*, 54*b*: STORAGE FORMING PORTION
55: LINE HOOKING PORTION
7: SENSOR
7*a*: HEAT SENSITIVE ELEMENT
7*b*: PROTECTIVE PORTION
71: LINE
72: CONNECTOR PORTION
720: BODY
721: NAIL PORTION
722: PROJECTION
6: GASKET
8: TERMINAL FITTING

81: JOINING PORTION
9: TERMINAL FIXING MEMBER
91: BOLT
1100: POWER CONVERTER APPARATUS
1110: CONVERTER
1111: SWITCHING ELEMENTS
1112: DRIVER CIRCUIT
L: REACTOR
1120: INVERTER
1150: POWER SUPPLY APPARATUS-USE CONVERTER
1160: AUXILIARY POWER SUPPLY-USE CONVERTER
1200: VEHICLE
1210: MAIN BATTERY
1220: MOTOR
1230: SUB-BATTERY
1240: AUXILIARY EQUIPMENT
1250: WHEELS

The invention claimed is:

1. A reactor, comprising:
a coil;
a magnetic core at which the coil is disposed; and
a case that stores a combined product made up of the coil and the magnetic core, wherein
the case includes a bottom plate portion on which the combined product is placed and a side wall portion that surrounds the combined product,
at least part of the side wall portion is made of resin, and
a connector hooking portion on which a connector portion coupled to a sensor measuring a physical quantity of the reactor is hooked is integrally molded with the side wall portion by the resin.

2. The reactor according to claim 1, wherein
the side wall portion is entirely made of an insulating resin, the side wall portion being a member independent of the bottom plate portion, and the side wall portion being integrated with the bottom plate portion by a fixation member.

3. The reactor according to claim 1, wherein
the magnetic core includes an inner core portion covered by the coil and an outer core portion exposed outside the coil,
the side wall portion includes an overhanging portion covering at least part of the outer core portion disposed on an opening side of the case, and
the connector hooking portion is provided at the overhanging portion.

4. The reactor according to claim 1, further comprising
a line hooking portion on which a line coupled to the sensor is hooked, the line hooking portion being integrally molded with the side wall portion by the resin.

5. The reactor according to claim 1, wherein
the combined product includes an insulator interposed between the coil and the magnetic core, and
the insulator is integrated by a pair of divided pieces being combined, the reactor further comprising
a space formed as are result of combining the divided pieces as a storage portion for the sensor.

6. The reactor according to claim 2, wherein
the bottom plate portion is made of a metal material.

7. A converter, comprising:
a switching element;
a driver circuit that controls an operation of the switching element; and
a reactor that smoothes a switching operation, wherein
an input voltage is converted by the operation of the switching element, and
the reactor is the reactor according to claim 1.

8. A power converter apparatus, comprising:
a converter that converts an input voltage; and
an inverter that is connected to the converter and that performs interconversion between a direct current and an alternating current, wherein
a load is driven by power obtained by the conversion performed by the inverter, and
the converter is the converter according to claim 7.

* * * * *